US006037576A

United States Patent [19]

Okabayashi et al.

[11] Patent Number: 6,037,576

[45] Date of Patent: Mar. 14, 2000

[54] APPARATUS AND METHOD FOR DETECTING A CONDITION IN AN INDUCTIVE HEATING DEVICE

[75] Inventors: Eiji Okabayashi, Toyokawa; Tetsuro Ito, Anjo; Yuusuke Morigami, Toyohashi; Takeshi Kato, Itami; Taizou Oonishi, Toyokawa, all of Japan

[73] Assignee: Minolta Co., Ltd., Osaka, Japan

[21] Appl. No.: 08/917,843

[22] Filed: Aug. 27, 1997

[30] Foreign Application Priority Data

| | | | |
|---|---|---|---|
| Aug. 30, 1996 | [JP] | Japan | 8-229910 |
| Aug. 30, 1996 | [JP] | Japan | 8-229912 |
| Aug. 30, 1996 | [JP] | Japan | 8-229934 |
| Aug. 30, 1996 | [JP] | Japan | 8-230996 |

[51] Int. Cl.[7] ..... H05B 6/08

[52] U.S. Cl. ..... 219/619; 219/665; 219/667; 399/330

[58] Field of Search ..... 219/619, 665, 219/667, 635, 645, 469; 399/69, 328, 330, 331, 335, 336, 338

[56] References Cited

U.S. PATENT DOCUMENTS

| | | | |
|---|---|---|---|
| 2,871,940 | 2/1959 | Meunier | 219/645 |
| 3,187,150 | 6/1965 | France | 219/619 |
| 3,686,460 | 8/1972 | Lamparter et al. | 219/619 |
| 5,434,389 | 7/1995 | Griebel | 219/665 |
| 5,739,506 | 4/1998 | Hanton et al. | 219/645 |
| 5,752,148 | 5/1998 | Yoneda et al. | 399/329 |

FOREIGN PATENT DOCUMENTS

| | | |
|---|---|---|
| 07114276 | 5/1995 | Japan . |
| 07253731 | 10/1995 | Japan . |
| 07295414 | 11/1995 | Japan . |
| 08016007 | 1/1996 | Japan . |
| 08044226 | 2/1996 | Japan . |
| 08044227 | 2/1996 | Japan . |
| 08129313 | 5/1996 | Japan . |

*Primary Examiner*—Philip H. Leung
*Attorney, Agent, or Firm*—McDermott, Will & Emery

[57] ABSTRACT

An induction heating fixing device is disclosed which is provided with a conducting sleeve, a coil for causing the sleeve to generate an induced current, and a high-frequency power source for feeding a high-frequency wave to the coil. This fixing device detects the switching cycle of the high-frequency power source and the electric power injected into the sleeve and, based on the detected switching cycle and the detected electric power, controls the amount of electric current to be fed from the high-frequency power source to the coil.

17 Claims, 20 Drawing Sheets

VOLTAGE (V)
TIME

SWITCHING WAVEFORM
ON-TIME
ON
OFF
Tsw
SWITCHING CYCLE

COIL CURRENT WAVEFORM
CURRENT (A)

APPARATUS AND METHOD FOR DETECTING A CONDITION IN AN INDUCTIVE HEATING DEVICE

BACKGROUND OF THE INVENTION

1. Field of the Invention

This invention relates to a heating device intended as a heat source for a fixing unit to be used in electrophotographic copying systems, printers, and facsimile systems. More specifically, this invention relates to a heating device which makes use of induction heating.

2. Description of the Related Art

The electrophotographic copying system, for example, is provided with a fixing unit which fixes on the sheet of a recording paper or a transfer material a developing agent which has been transferred to the sheet. As the heat source for this fixing unit, what makes use of electromagnetic induction heating has been proposed.

The fixing unit which utilizes induction heating is at an advantage in allowing faster elevation of temperature and consuming less electric power than the unit which effects indirect heating by the use of a halogen lamp as a heat source.

Generally, the control of the temperature of the fixing unit is attained by a procedure which comprises detecting the temperature of a fixing roller by the use of a thermistor kept in contact with the fixing roller in rotation, comparing the detected temperature with a set temperature (in the approximate range of 150–200° C., for example), and effecting ON-OFF control of the heat source or duty control based on the outcome of the comparison. The control of this nature has found utility not only in the fixing unit using a halogen lamp as the heat source but also in the fixing unit resorting to induction heating.

The thermistor which is a temperature detecting means generally produces a delay in such a feedback control as is described above because of its own thermal capacity and delay in heat transmission. The delay has posed no particular problem to the fixing unit which uses a halogen lamp allowing no noticeably fast temperature elevation as the heat source. In the fixing unit which utilizes induction heating capable of high-speed temperature elevation, the response characteristic of the thermistor affects the temperature ripple and the overshoot during the control possibly to a point where the temperature of the roller of the fixing unit will not be retained constantly and the quality of the fixed image will be adversely affected.

A method for predicting a heating condition by detecting the upward or downward trend of temperature has been conceived. It does not easily obtain a stable fixing property. For this method to attain the stable fixing property, it incurs such problems as necessitating the development of a control device exclusively used for that purpose and inevitably increasing the cost of equipment.

As a fixing unit of the form utilizing the aforementioned induction heating, JP-A-07-114,276, for example, discloses a fixing unit which attains the fixation of a toner image on a recording paper by causing a film possessing a conducting layer in conjunction with the recording paper carrying thereon an unfixed toner image to be nipped in a nipping part between a supporting member and a pressing roller and enabling the pressing roller to advance sympathetically the film in conjunction with the recording paper.

The fixing unit of this form, however, has the problem that when the film possessing the conducting layer happens to sustain a scratch for some cause or other while it is verging on rotation, this film is seriously fractured in consequence of the aggravation of the scratch by the rotation. When the film suffers the fracture of this nature, the fractured film will possibly scatter in the fixing unit and inflict damage to even the parts other than the fixing unit. If the fractured film falls short of being scattered, there still arises the problem that the magnetic flux which is inherently concealed by the conducting layer of the film possibly leaks through the scraped part and exposes the other metallic members to induction heating.

SUMMARY OF THE INVENTION

An object of this invention is to provide a heating device of high reliability to be used in the fixing unit.

A further object of this invention is to provide a heating device capable of detecting the state of a sleeve.

Another object of this invention is to provide a heating device capable of infallibly effecting the adjustment of a temperature.

Still another object of this invention is to provide a heating device capable of infallibly detecting a breakage in a sleeve.

The heating device of this invention which accomplishes these objects comprises a sleeve made of an electrical conductive material, an electromagnet having a coil and a core, an electrical power source, connected with the coil, for applying high-frequency electrical current to the coil to heat the sleeve by magnetic induction, and detector which detects condition of the sleeve based on an electrical power applied to the coil.

DETAILED DESCRIPTION OF THE PREFERRED EMBODIMENTS

Now, the embodiments of this invention will be described below with reference to the drawings annexed hereto.

EXAMPLE 1

Figure 1:
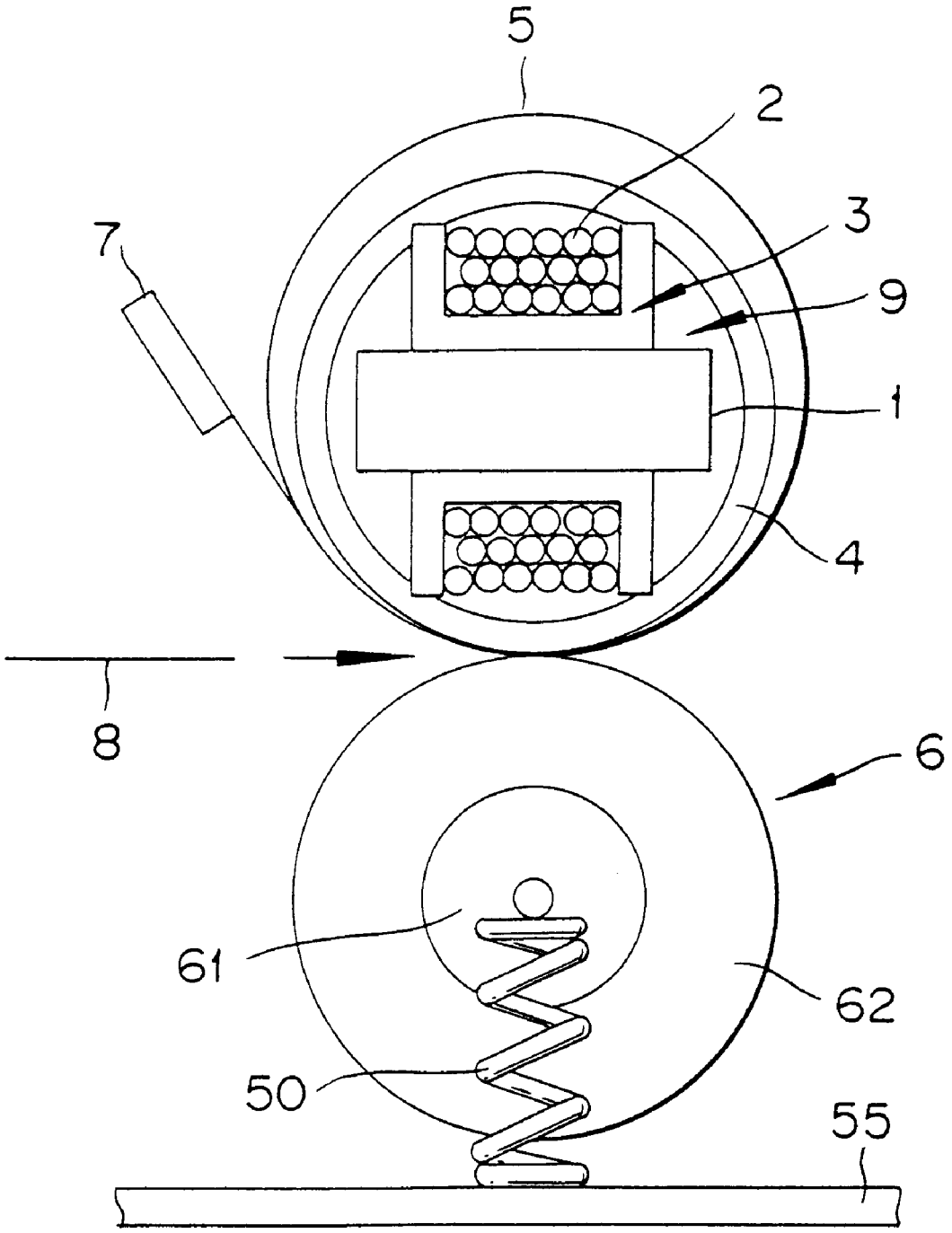
FIG. 1 is a side view illustrating schematically the construction of an induction heating fixing unit of Example 1 embodying the present invention.

FIG. 1 is a side view illustrating an induction heating fixing unit which embodies this invention.

This fixing unit utilizes an induction heating setup as a heat source and, as illustrated in FIG. 1, comprises a coil assembly 9 composed of a core 1 and a coil 2 wound helically around the core 1 and accommodated in a holder 4 and a metallic flexible sleeve 5 adapted to generate heat by the induced current of the coil and wound around the holder 4. Then, a pressure roller 6 which is rotationally driven presses the holder 4 across the sleeve 5 and causes a sheet (recording medium) 8 to be moved to and through the nip part and, at the same time, allows the sleeve 5 to be sympathetically moved in conjunction with the recording medium 8, with the result that a toner deposited as a developing agent on the recording medium 8 will be melted and fixed.

The sleeve 5 is preferred to be made of such a ferromagnetic substance as iron or nickel. When this sleeve 5 is made of the ferromagnetic substance, it enjoys an improved heat generating efficiency because it allows numerous magnetic fluxes to pass therethrough. This sleeve 5 prefers the metallic layer thereof to have a thickness in the approximate range of 20–60 $\mu$m. The thermal capacity decreases and the electric power consumed for heat generation consequently decreases in accordance as the thickness of the sleeve 5 decreases. If the thickness of the sleeve 5 is decreased excessively, however, the sleeve 5 will suffer the strength thereof to diminish and tend to fracture. The diminution of strength will also render the manufacture of this sleeve 5 in a uniform thickness difficult. Conversely, if the sleeve 5 has an unduly large thickness, it will succumb to a bend and will suffer the nip part thereof to manifest lowered durability to a partial bend.

On the outer wall surface of the sleeve 5, a heat-resistant mold release layer (not shown) is formed of fluorine resin in a very small thickness.

This sleeve 5 is not fixed to any of the parts in the unit but is allowed to rotate freely round the holder 4. The holder 4 is fixed to the main body of the unit. The surface of the holder 4, at least the part of the surface destined to contact the sleeve 5, is formed of a smooth heat-resistant resin material so that the friction resistance between the holder 4 and the sleeve 5 may be smaller than the friction resistance between the sheet 8 and the sleeve 5. As a result, the sleeve 5 is moved sympathetically by the sheet 8 which is moved by the rotation of the pressure roller 6. The holder 4 is provided at the opposite ends thereof with flanges (not shown) adapted to prevent the sleeve 5 from being deviated in the longitudinal direction of the holder 4.

The coil assembly 9 is provided on the periphery of the core 1 thereof with an insulating bobbin 3. The coil 2 is formed by winding a copper wire around this bobbin 3. Preferably, the bobbin 3 is formed of a ceramic substance or a heat-resistant engineering plastic substance and the coil 2 is formed of a simple or a litz copper wire provided on the surface thereof with a fused layer and an insulating layer. The core 1 is a ferrite core or a laminated core, for example.

The pressure roller 6 is composed of an axial core 61 and a silicone rubber layer 62, i.e. a surface releasing heat-resistant rubber layer, provided on the opposite ends thereof with slide bearings (not shown), and pressed by a spring member 50 in the direction of the holder 4 across the sleeve 5 as against a fixing unit frame 55 of the main body of the fixing unit and rotatably fitted thereto. Further, the pressure roller 6 has a drive gear (not shown) fixed to one end thereof and is rotationally driven by such a drive source as a motor (not shown) connected to the drive gear.

The sleeve 5 is further provided with a temperature sensor adapted to contact the sleeve 5 and detect the temperature thereof. This temperature sensor is formed of a thermistor 7, for example. As a mechanism for safety from abnormal rise of temperature, a thermostat or a temperature fuse capable of breaking power supply to the coil 2 on detecting an abnormal rise of temperature may be provided in addition to the thermistor 7.

Figure 2:
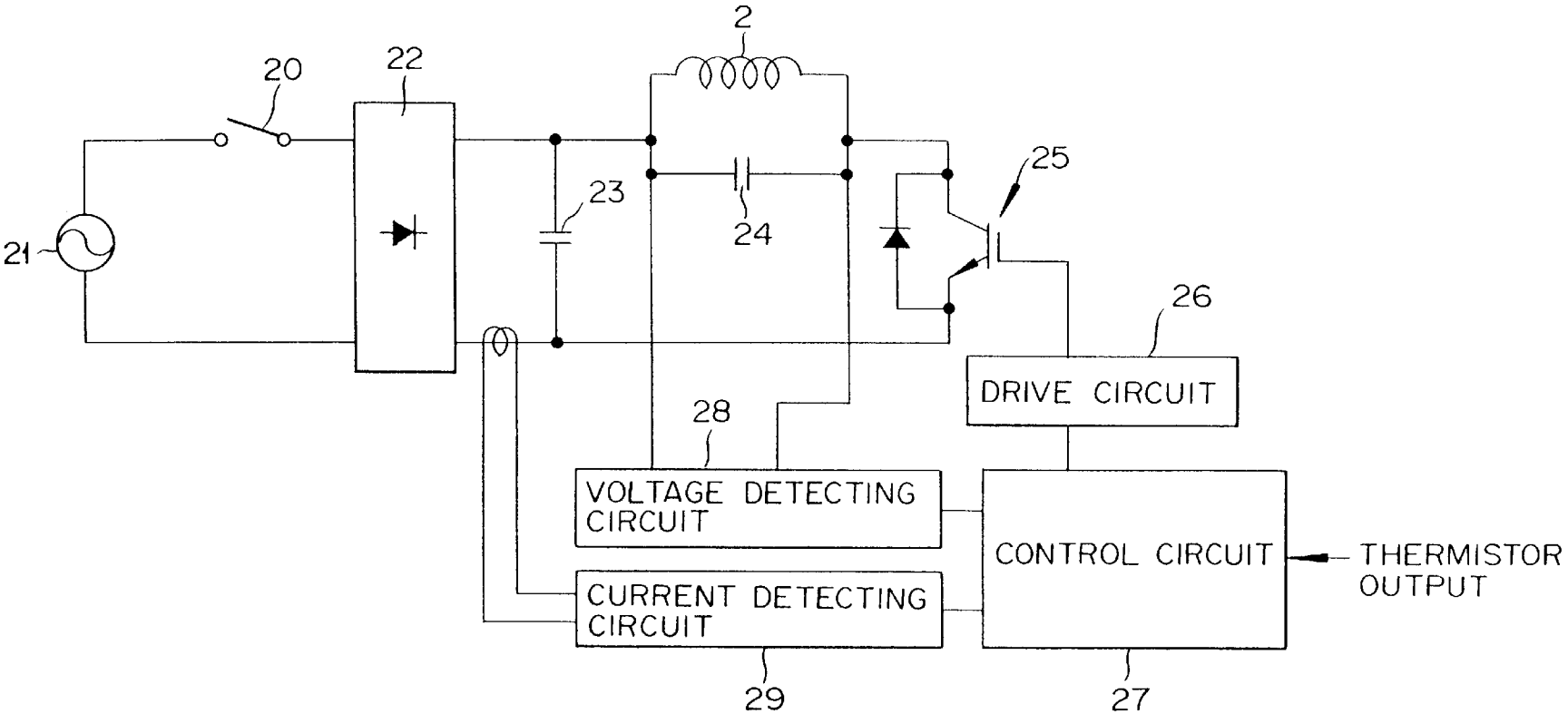
FIG. 2 is a block diagram depicting a control system of the induction heating fixing unit of Example 1 mentioned above.

FIG. 2 is a block diagram illustrating a control system for this fixing unit.

For supply to the coil 2, an alternating current emanating from a commercial power source 21 is rectified by a rectifier circuit 22 and a smoothing capacitor 23 and then converted into a high-frequency electric current by an inverter circuit composed of the coil 2, a resonant capacitor 24, and a switch circuit 25. This high-frequency electric current is controlled by a control circuit 27 with a voltage and a current which are detected by a voltage detecting circuit 28 and a current detecting circuit 29 as follows. A power source switch 20 is disposed in a route extending from the commercial power source 21 to the rectifier circuit 22. As a mechanism for safety, a thermostat or a temperature fuse may be provided on this route.

Figures 3A, 3B, 3C:
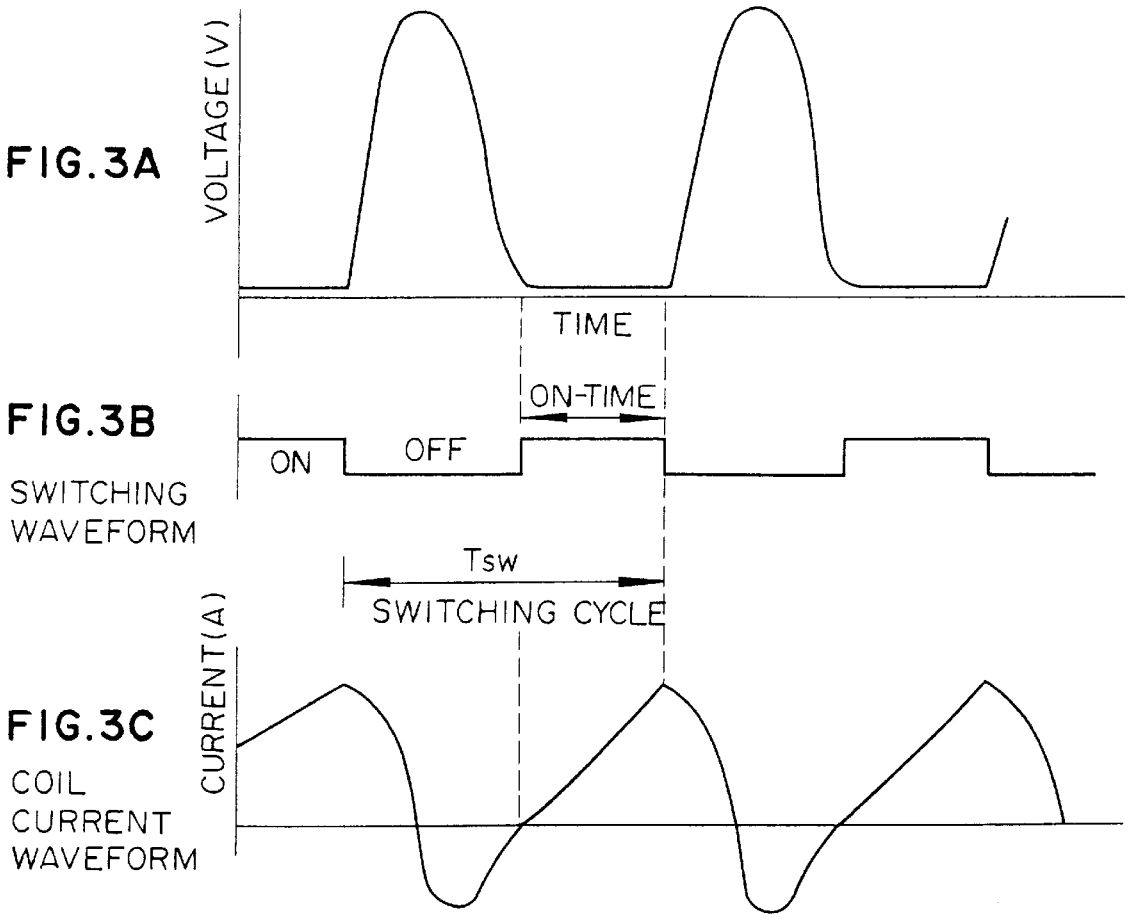
FIG. 3 is a diagram to aid in the description of the control of high-frequency current, FIG. 3A representing the change in voltage, FIG. 3B the change in switching, and FIG. 3C the change in current.

FIG. 3 is a time chart to aid in the description of the control of the high-frequency current, FIG. 3A showing the magnitude of the voltage between the opposite terminals of the coil detected by the voltage detecting circuit 28, FIG. 3B the operation of the switch circuit 25, and FIG. 3C the magnitude of electric current detected by the current detecting circuit 29.

First, as the basic control of the high-frequency electric current, a drive circuit 26 turns on the switch circuit 25 formed of a transistor, FET, or IGBT, for example, by means of the control signal emitted from the control circuit 27 as shown in FIG. 3, with the result that the electric current will flow to the coil 2. Then, the control circuit 27, based on the magnitude of electric current detected by the current detecting circuit 29, the magnitude of voltage detected by the voltage detecting circuit 28, and the switching cycle (frequency), transmits to the drive circuit 26 a signal to turn off the switch circuit 25.

When the switch circuit 25 is turned off, a resonant current flows between the coil 2 and the resonant capacitor 24. When the voltage detecting circuit 28 detects the fact that the voltage between the opposite terminals of the coil 2 is lowered closely to 0 V by the resonance, the control circuit 27 transmits to the drive circuit 26 a signal to turn on the switch circuit 25. By repeating this switching cycle thereafter, the high-frequency electric current is forwarded to the coil 2.

When the electric current of high frequency (several kHz—some tens of kHz) consequently flows to the coil 2, the core 1 generates magnetic fluxes perpendicular to the direction of the longitudinal axis of the sleeve 5 in accordance with the "Ampere's right-hand screw rule" and, by the action of the concentrated magnetic fluxes, the sleeve 5 generates an eddy induced current in accordance with the "Lenz's law." As this induced current is converted by the skin resistance of the sleeve 5 into a Joule heat, the sleeve 5 is caused to generate heat.

Now, the control of the high-frequency current for the control of the temperature of the sleeve 5 will be described below.

In Example 1, the temperature of the sleeve is controlled based on the relation between the temperature of the sleeve, the electric power injected into the coil, and the frequency of the high-frequency current.

This control makes use of the general characteristic of a metal that the impedance of the metal is varied by the change in the temperature thereof.

Figure 4:
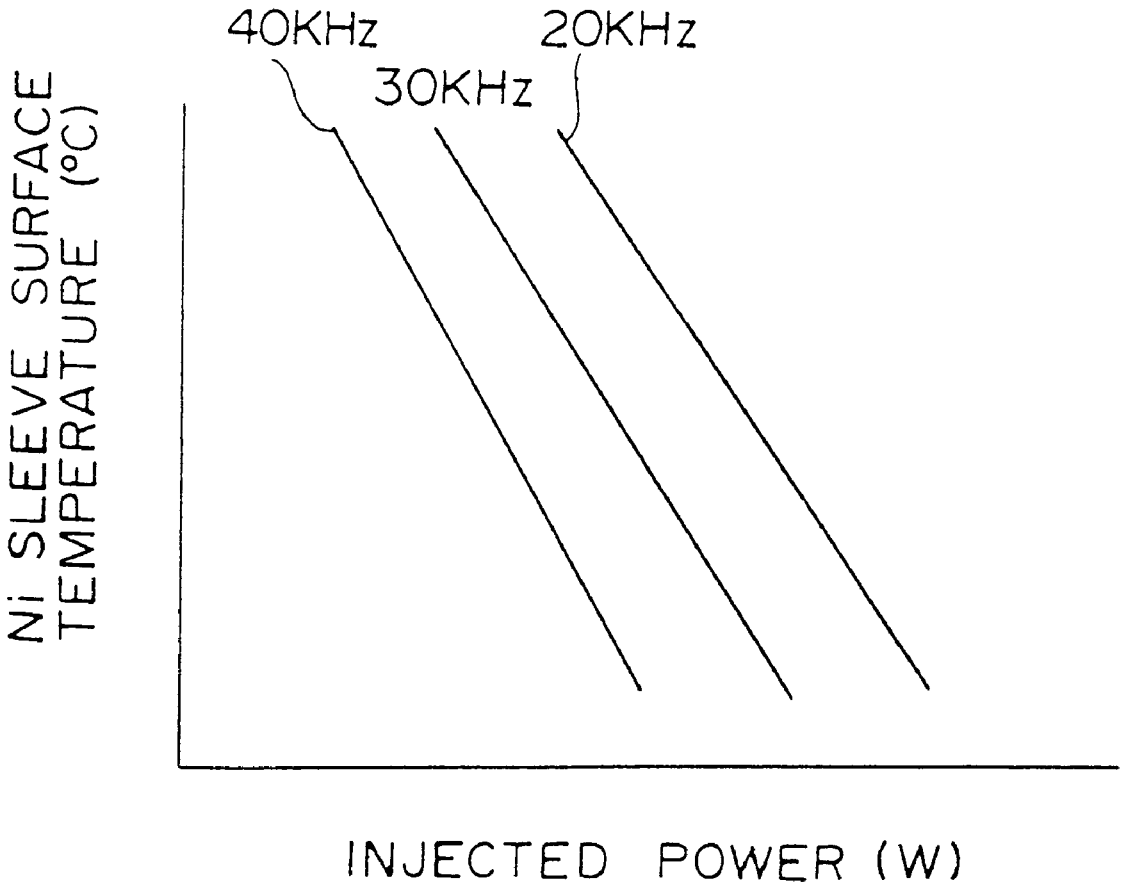
FIG. 4 is a diagram showing the relation between the temperature of a nickel (Ni) sleeve and the electric power used at a varying frequency.

When a nickel sleeve having a metal layer, 20–60 $\mu$m in wall thickness, is adopted as the sleeve 5 to be used in Example 1, for example, the electric power consumed by the flow of the high frequency (approximately 30 kHz herein) to the coil decreases in proportion as the temperature increases as shown in FIG. 4 owing to the temperature characteristic of nickel. This trend persists, though the power consumed varies with the frequency. Owing to this particular relationship, therefore, the temperature of a heating medium can be predicted based on the frequency and the power consumption.

The control circuit 27 mentioned above, therefore, calculates the power consumption based on the magnitude of voltage determined by the voltage detecting circuit 28 and the magnitude of current determined by the current detecting circuit and calculates the switching cycle or the frequency of the high-frequency current by measuring the interval between one switch on and a next switch on.

By thus detecting the power consumption and the switching cycle, the surface temperature is predicted in the light of the characteristic of the sleeve 5. Based on the outcome of this calculation, the switch-on time is lengthened so as to increase the amount of electric current to the coil when the measured temperature is lower than the prescribed temperature and the switch-on time is shortened so as to decrease the amount of electric current to the coil when the measured temperature is higher than the prescribed temperature. Since the amount of the current applied to the inverter can be controlled by means of the switch-on time as described above, it is allowed to obtain a high output by lengthening the switch-on time and proportionately lowering the frequency.

This calculation of the amount of control based on the power consumption and the frequency can be attained, for example, by adopting a personal computer as the control circuit 27, storing in a memory the characteristic of the sleeve 5 in the form of a table or a formula of calculation, digitizing the power consumption and the frequency, and performing a calculation of the resultant data. The temperature, therefore, can be accurately controlled without entailing any delay in response.

Example 1 also contemplates limiting the amount of electric current when either or both of the magnitudes of the electric power and the frequency calculated as described above are larger than the prescribed magnitudes stored in advance as in the memory. This control is intended to prevent the temperature of the sleeve from abnormally rising accidentally and, at the same time, preclude the otherwise possible flow of an unduly large amount of electric power when the temperature of the sleeve is low. The reason for this control is that the largest amount of electric current that is allowed for the fixing unit is generally limited, specifically to 15 A in the territory of Japan. Thus, the control is effected lest the amount of electric current should exceed 15 A. The thought that the fixing unit is usually disposed inside the copying system justifies an inference that the other elements of the copying system also necessitate electric power. The maximum amount of electric current to be used exclusively by the fixing unit is limited as described above, therefore, in anticipation of the possibility that the whole use of the prescribed amount of electric current (15 A) exclusively by the fixing unit may degrade the functions of the other elements of the copying system.

Besides the control mentioned above which is based on the power consumption and the frequency as described above, Example 1 contemplates controlling the temperature of the sleeve 5 by using the thermistor 7 in detecting the surface temperature of the sleeve 5.

By combining the detection of temperature by the thermistor with the control based on the amount of electric power and the frequency, it is made possible to control the temperature of the nip part at a proper fixing temperature by using the thermistor in detecting the local change of temperature of the nip part during the passage of paper therethrough. It is further made possible to correct dispersion of the temperature and attain highly accurate temperature adjustment. Since this operation constitutes itself double temperature detection, it provides infallible safety in case of a mechanical trouble.

Example 1 precludes the possible delay of the response of the thermistor by controlling the temperature by the detection of the power consumption and the frequency, copes with the local change of temperature of the sleeve, particularly the change of temperature in the nip part, by the detection of the temperature of the thermistor, and allows the temperature of the sleeve to be controlled with high accuracy as described above.

EXAMPLE 2

Next, another example embodying the present invention will be described below.

Figure 5:
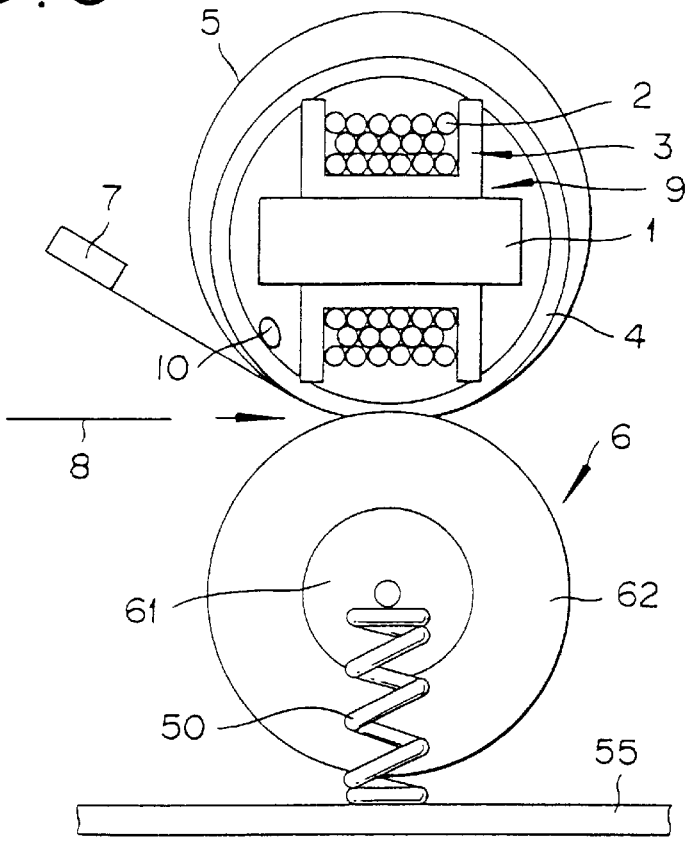
FIG. 5 is a side view illustrating an induction heating fixing unit of Example 2 embodying this invention.

FIG. 5 is a side view of an induction heating fixing unit of Example 2.

In Example 2, as illustrated in the diagram, a coil assembly 9 composed of a core 1 and a coil 2 wound helically around the core 1 is accommodated in a holder 4, a metallic flexible sleeve 5 is wound around the holder 4, and a pressure roller 6 which is rotationally driven presses the holder 4 across the sleeve 5 similarly to Example 1 mentioned above. Example 2 further provides the holder 4, i.e. a supporting member for pressing the sleeve 5 against the pressure roller 6, with a thermistor 10 destined to contact this holder 4. Since the operation of the fixing unit and the control of the high-frequency electric current are the same as those of Example 1, their description will be omitted here.

The reason for Example 2 to contemplate having the thermistor 10 disposed as held in contact with the holder 4 will be described below.

When the sleeve 5 to be used has a small thickness as in Example 2, since the thermal capacity of the sleeve 5 itself is extremely small, the thermal capacity of the holder 4 which is in contact with this sleeve 5 exerts an influence on the temperature of the sleeve 5. When the temperature of the sleeve 5 is elevated from the normal room temperature to the fixing temperature (such as, for example, 200° C.), the rate of the increase of temperature of the sleeve 5 tends to be slightly lowered because the holder 4 is cold and the sleeve 5 in contact thereof is deprived of the heat thereof by the holder 4. When the temperature of the sleeve 5 which has reached the fixing temperature is left falling during a waiting period and then is elevated again to the fixing temperature, since the holder 4 is once warmed to a certain degree in consequence of transmission of heat from the sleeve 5, this subsequent temperature elevation allows the sleeve 5 to reach the fixing temperature faster than when the temperature is elevated from the normal room temperature.

The influence of the thermal capacity of the holder 4 A mentioned above not only manifests itself in differentiating the rate of temperature elevation but also affects the control of temperature for the retention of the fixing temperature. Since the temperature of the holder 4 approximates closely to the normal room temperature immediately after the temperature of the sleeve 5 elevated from the normal room temperature reaches the fixing temperature, the sleeve 5 is deprived of the heat thereof by the holder 4 and the change of temperature of the sleeve 5 is increased in the case of the ON-OFF control.

Example 2, therefore, contemplates effecting the control of the temperature of the sleeve 5 by using the surface temperature of the sleeve 5 not exclusively but in association with the temperature of the holder 4.

Figure 6:
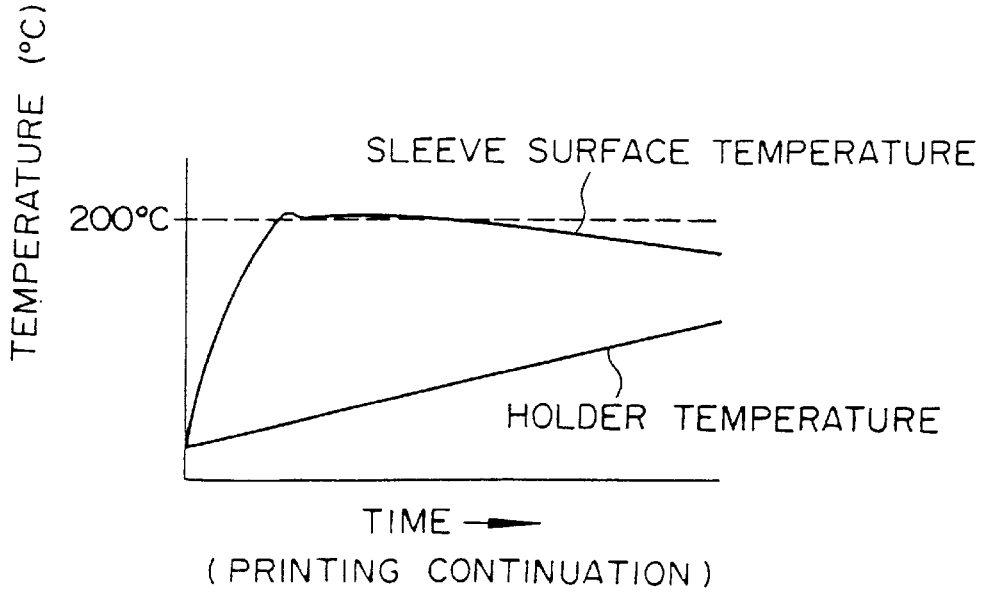
FIG. 6 is a diagram showing the relation between the fixing sleeve surface temperature and the holder temperature.

Specifically, as shown in FIG. 6, the temperature to be controlled by the thermistor 7 on the surface of the sleeve 5 is set at a high level when the temperature of the holder 4 is low and the control temperature on the surface of the sleeve 5 is lowered when the temperature of the holder 4 is high. When the temperature of the holder 4 is high, the transmission of heat to the sheet is improved because the heat of the sleeve 5 does not easily escape to the holder 4. By the control which is effected as described above, the holder 4 is enabled to manifest a stable fixing property even at high temperatures.

When the surface temperature of the sleeve 5 is deviated from the target control temperature by such a disturbance as occurs during the entry of a recording paper into the nip part, for example, the electric power required for restoring the temperature from the disturbance is variable with the existent temperature of the holder 4. The memory of the control part keeps in storage therein the relation between the temperature of the holder 4 and the electric power for restoration from the deviation and fixes the amount of control (electric power) based on this memory. By this method, the surface temperature of the sleeve 5 can be stabilized.

It is made possible to adjust the temperature of the sleeve 5 more accurately by detecting the temperature of the holder 4 as described above. The temperature control of this nature, when combined with the temperature control attained by the detection of electric power and frequency as in Example 1 above, is enabled to enjoy a further addition to the accuracy of measurement. The temperature control which resorts solely to the detection of the surface temperature of the sleeve, when adapted to incorporate the temperature of the holder as an additional parameter for measurement, is allowed to gain in accuracy.

EXAMPLE 3

Another example embodying this invention will be described below.

Example 3 is identical in the mechanical structure with what is depicted by FIG. 1 in Example 1 mentioned above and different in the structure of the control system therefrom. To be specific, the mechanical structure of the fixing unit in Example 3 roughly comprises a flexible thin-wall metallic sleeve 5 adapted for induction heating, a holder 4 for pressing the sleeve 5 against a pressure roller 6, a coil assembly adapted to subject the sleeve 5 to induction heating and disposed inside the holder 4, and a thermistor 7 adapted for detection of temperature and disposed in sliding contact with the sleeve 5.

Now, the control system in Example 3 will be described below.

Figure 7:
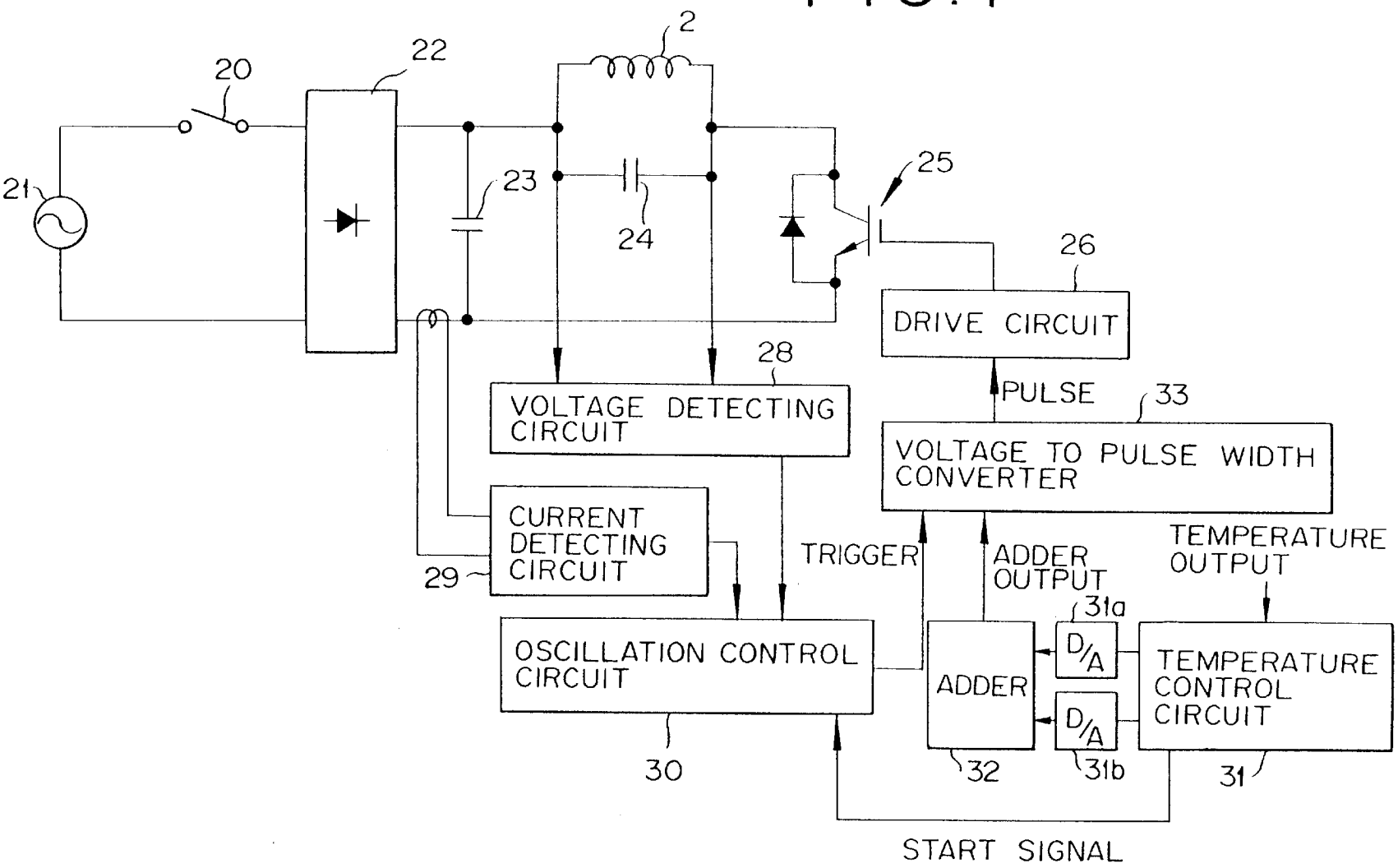
FIG. 7 is a block diagram of a control system of an induction heating fixing unit of Example 3 embodying this invention.

FIG. 7 is a block diagram of the control system in the fixing unit of Example 3.

The supply of a high-frequency current to a coil 2 is attained, similarly to that in Example 1 described above, by rectifying an alternating current from a commercial power source 21 by means of a rectifying circuit 22 and a smoothing capacitor 23 and forwarding the product of rectification to the coil 2 by means of an inverter circuit composed of the coil 2, a resonant capacitor 24, and a switch circuit 25.

The control of the high-frequency current in Example 3 consists in the fact that an oscillation control circuit 30 emits a trigger signal for the oscillation of a high-frequency wave based on the voltage and the current detected respectively by a voltage detecting circuit 28 and a current detecting circuit 29 as described below and a temperature control circuit 31 transmits to a drive circuit 26 an instruction to effect temperature control based on a temperature detection signal from a thermistor 7.

In the basic control required for the application of the high-frequency current (refer to FIG. 3), the switch circuit 25 is retained in the ON state for a duration equivalent to the width of a pulse emitted from a voltage to pulse width converter 33 to the drive circuit 26 as described hereinbelow. During the life of the ON state of the switch, the electric current flows to the coil 2 and the resonant capacitor 24. When the switch circuit 25 is turned off, a resonant current flows between the coil 2 and the resonant capacitor 24. When the voltage detecting circuit 28 detects the fact that the voltage between the opposite terminals of the coil 2 is lowered by resonance to the neighborhood of 0 V, the oscillation control circuit 30 emits a trigger signal for turning on the switch circuit 25 again. By subsequently repeating this switching cycle, the high-frequency current is supplied to the coil 2.

The control of the temperature of the sleeve 5 is fulfilled by the temperature control circuit 31 as described above. The temperature control circuit 31 calculates the difference between the existent temperature of the thermistor 7 and the adequate fixing temperature and, based on the temperature difference, emits two signals, i.e. a signal (digital value) for coarse adjustment and a signal (digital value) for fine adjustment. Then, the coarse-adjustment signal and the fine-adjustment signal are respectively converted by D/A converters 31*a* and 31*b* into analog values of voltage, which are totaled by an adder 32 and forwarded to the voltage to pulse width converter 33. The voltage to pulse width converter 33, in response to the introduction of a trigger signal from the oscillation control circuit 30, emits to the drive circuit 26 a pulse signal conforming to the introduced voltage. In short, the temperature of the sleeve 5 is retained at the level adequate for the fixation by the fact that the duration of the ON state of the switch circuit 25 is varied by the instruction of the temperature control circuit 31 and the amount of the electric power supplied to the coil 2 is proportionately varied.

Here, the reason for causing the temperature control circuit 31 to emit the two signals, i.e. the signal for coarse adjustment and the signal for fine adjustment, and utilize the sum of the two signals for the control of temperature in Example 3 will be explained below.

FIG. 8 is a time chart showing the relation between the temperature of the sleeve, the state of passage of a recording paper, and the electric power for the temperature control.

Figure 8A:
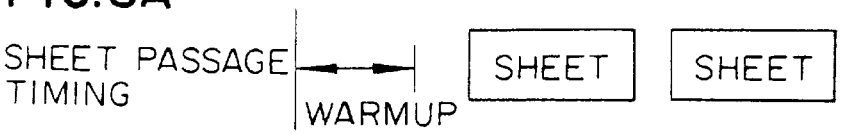
FIG. 8 is a diagram to aid in the description of the timing of paper passage and the adjustment of temperature and electric power of the fixing sleeve, FIG. 8A representing the timing of paper passage, FIG. 8B the fixing sleeve temperature, and FIG. 8C the electric power.
Figure 8B:
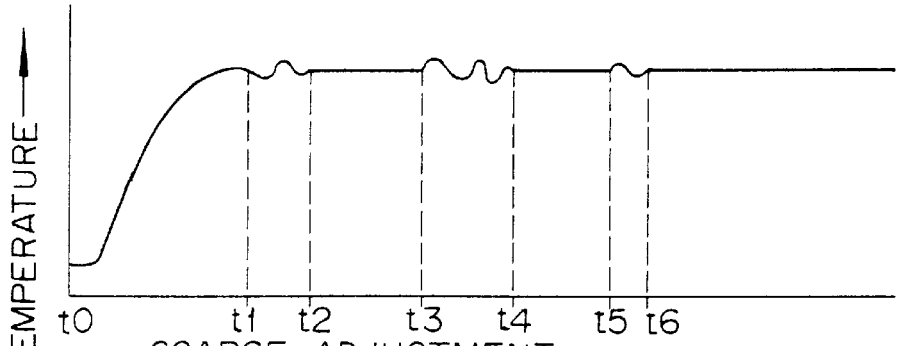
Figure 8C:
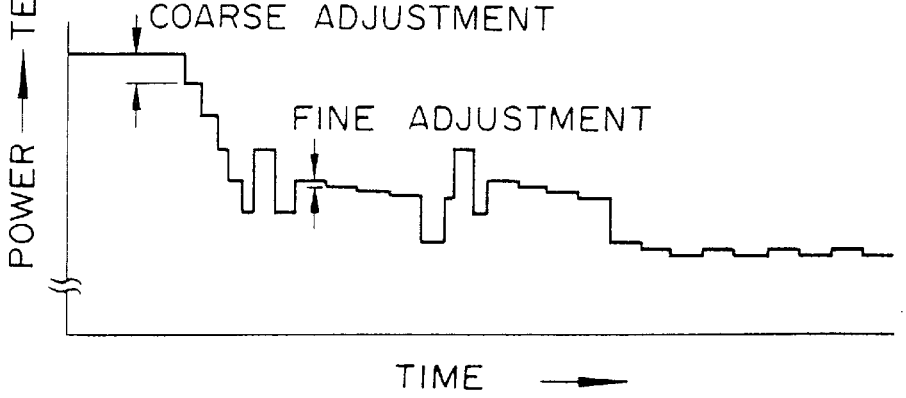
Figure 9:
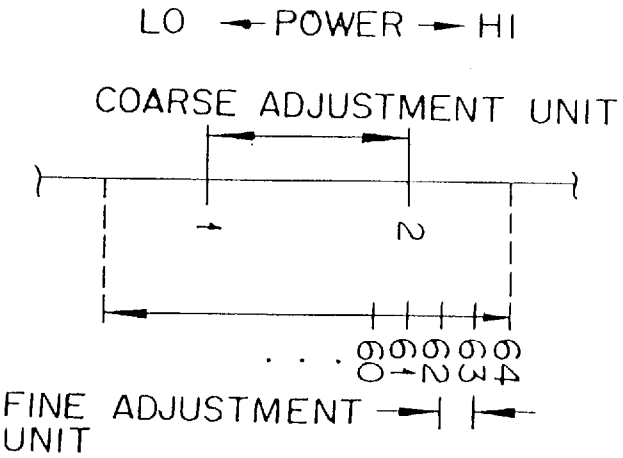
FIG. 9 is a diagram to aid in the description of the unit of coarse adjustment and the unit of fine adjustment.

The temperature of the sleeve 5, as shown in FIG. 8A and FIG. 8B, possibly changes relatively widely during the rise of temperature from the room temperature to the adequate fixing temperature (warmup time) and at the time of entry of paper into the nip part and immediately after the discharge of the paper from the nip part (in the intervals t0–t1, t1–t2, t3–t4, t5–t6, etc. shown in FIG. 8B, referred to hereinafter as "coarse adjustment intervals") or very slightly during the absence of passage of paper and in the course of passage of paper (in the intervals t2–t3, t4–t5, etc. shown in FIG. 8B, referred to hereinafter as "fine adjustment intervals"). In Example 3, the coarse adjustment intervals having wide changes of temperature are controlled by coarse adjustment and the fine adjustment intervals having small changes of temperature by fine adjustment as shown in FIG. 8C.

When the coarse adjustment intervals having wide temperature differences and the fine adjustment intervals having small temperature differences are subjected to digital control by the use of a personal computer, the steps that can be divided by the personal computer are determined by the performance of a D/A converter in the personal computer, namely by the number of bits handled by the D/A converter. When the D/A converter is rated for 6-bit data, for example, the control is effected as divided into 64 steps. When the coarse adjustment is performed by the use of this personal computer which is rated for a total power consumption of up to about 1 kW, the maximum adjustment that can be attained per unit is only 16 W on the condition that the electric power as the control output for controlling temperature from 20° C. to 200° C. is divided into 64 parts. Since the control unit is unduly large, therefore, the personal computer is not capable of effecting the fine adjustment of temperature. Thus, Example 3 contemplates setting the electric power per unit coarse adjustment interval at 16 W as mentioned above and further effecting the fine adjustment by dividing a part equivalent to about two units of coarse adjustment into 64 steps. In this case, the electric power per unit fine adjustment interval is 0.5 W and this fact indicates that the electric power of control output can be adjusted with considerable fineness.

Specifically, the temperature detected by the thermistor 7 and the adequate fixing temperature are compared to find the difference therebetween, the number of temperature differences included per unit coarse adjustment in the found difference is calculated, and the number of fine adjustment units required is calculated based on the outcome of the preceding calculation. Then, the amount of coarse adjustment and the amount of fine adjustment are severally put out, subjected to D/A conversion, summed by means of the adder 32, and converted into necessary pulse widths.

As a result, one personal computer using a small number of bits suffices for enabling the temperature control to be effected with considerable fineness.

Of course, the adjustment intervals including the fine adjustment intervals as well can be controlled by the use of one personal computer. This control, however, is at a disadvantage in involving many steps for division, requiring use of an expensive personal computer using a large number of bits, and consequently entailing an addition to the cost of the fixing unit.

EXAMPLE 4

Example 4 concerns addition of a structure for the detection of abnormality in the sleeve 5 to the structure of Example 1 described above.

Figure 10:
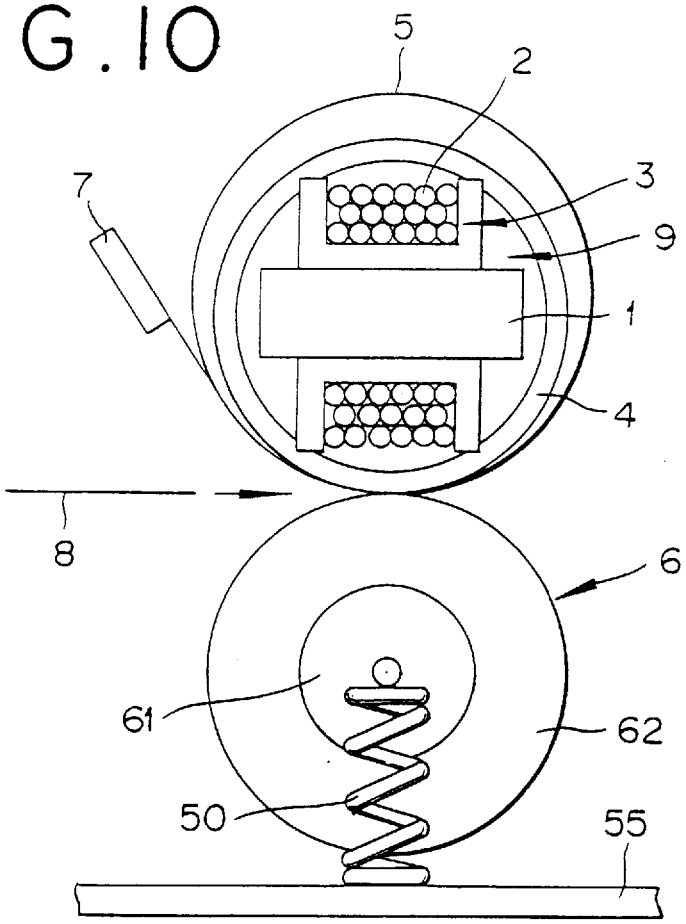
FIG. 10 is a side view illustrating an induction heating fixing unit of Example 4 embodying this invention.

FIG. 10 is a side view illustrating an induction heating fixing unit contemplated by Example 4.

In this induction heating fixing unit, as illustrated in FIG. 10, a coil assembly 9 composed of a core 1 and a coil 2 wound around the core 1 is accommodated in a holder 4 and a metallic flexible sleeve 5 caused by the induced current in the coil 2 to generate heat is wound around the holder 4. A press roller 6 adapted for a rotational operation presses the holder 4 across the sleeve 5, causes a sheet 8 to be moved to and passed through the nip part and, at the same time, enables the sleeve 5 to be moved in concert with the sheet 8, and induces the toner deposited as a developer on the sheet to be fused and fixed.

A high-frequency power source adapted for the application of a high-frequency current is connected to the coil 2. The sleeve 5, the coil 2, and the power source jointly form a magnetic circuit for heating the sleeve 5 by electromagnetic induction. A control circuit for controlling the high-frequency current to be passed for the temperature adjustment from the high-frequency power source through the coil 2 is also connected to the coil 2.

The sleeve 5 is preferred to be made of a ferromagnetic material such as, for example, iron or nickel. The sleeve 5, by being ferromagnetic in quality, is enabled to generate heat with improved efficiency because the number of magnetic fluxes to pass therethrough is increased. This sleeve 5 is also preferred to have a thickness in the approximate range of 20–60 $\mu$m. As the thickness of the sleeve 5 decreases, the thermal capacity of the sleeve 5 decreases, and the electric power consumed for generation of heat decreases, and the speed of temperature rise increases proportionately. If the thickness of the sleeve 5 is excessively decreased, however, the sleeve 5 will lose strength and tend to sustain fracture. Further, the sleeve 5 of an unduly small thickness, during the course of manufacture, acquires a uniform thickness only with difficulty. Conversely, if the thickness of the sleeve 5 is excessively increased, the sleeve 5 will be vulnerable to a bend and will exhibit low durability to a partial bend in the nip part.

This sleeve 5 is not fixed to any of the components in the unit but is allowed to rotate freely round the holder 4. In contrast, the holder 4 is fixed to the main body of the unit. The surface of the holder 4, or at least the part of the surface that contacts the sleeve 5, is formed of a smooth heat-resistant resinous material so that the friction resistance between the holder 4 and the sleeve 5 i s smaller than the friction resistance between the sheet 8 and the sleeve 5. Thus, the rotation of the press roller 6 causes the sleeve 5 to follow the motion of the sheet 8. The holder 4 is provided at the opposite ends thereof with flanges (not shown) which prevent the sleeve 5 to deviate in the longitudinal direction of the holder 4. The sleeve 5 has formed on the peripheral face thereof a very thin heat-resistant release layer (not shown) made of fluorine resin and, therefore, is enabled to exhibit improved releasability to a sheet such as, for example, a recording paper especially on a face carrying a toner image.

The coil assembly 9 is provided around the core 1 with an insulating bobbin 3. The coil 2 is formed by winding a copper wire around this bobbin 3. The bobbin 3 has only to be formed of a ceramic substance or a heat-resistant insulating engineering plastic substance, for example. The coil 2 is preferred to be a simple or litz copper wire which is provided on the surface thereof with a fused layer and an insulating layer. The core 1, for example, is a ferrite core or a laminate core.

The pressure roller 6 has formed on the periphery of a core 61 a silicone rubber layer 62 which is a surface release type heat-resistant rubber layer. It is provided at the opposite ends thereof with slip bearings. It is pressed with a spring member 50 in the direction of the holder -4 across the sleeve 5 as against a fixing unit frame 55 of the device proper and is rotatably fitted thereto. Further, the pressure roller 6 has fixed at the end thereof a drive gear (not shown). It is rotated by a drive source (not shown) such as a motor which is connected to the drive gear.

The sleeve 5 is provided with a temperature sensor which is disposed contiguously to the sleeve 5 and adapted to detect the temperature of the sleeve 5. This temperature sensor is formed of a thermistor 7, for example. As a mechanism for safety from abnormal rise of temperature, a thermostat or a temperature fuse capable of breaking power supply to the coil 2 on detecting an abnormal rise of temperature may be provided in addition to the thermistor 7.

Figure 11:
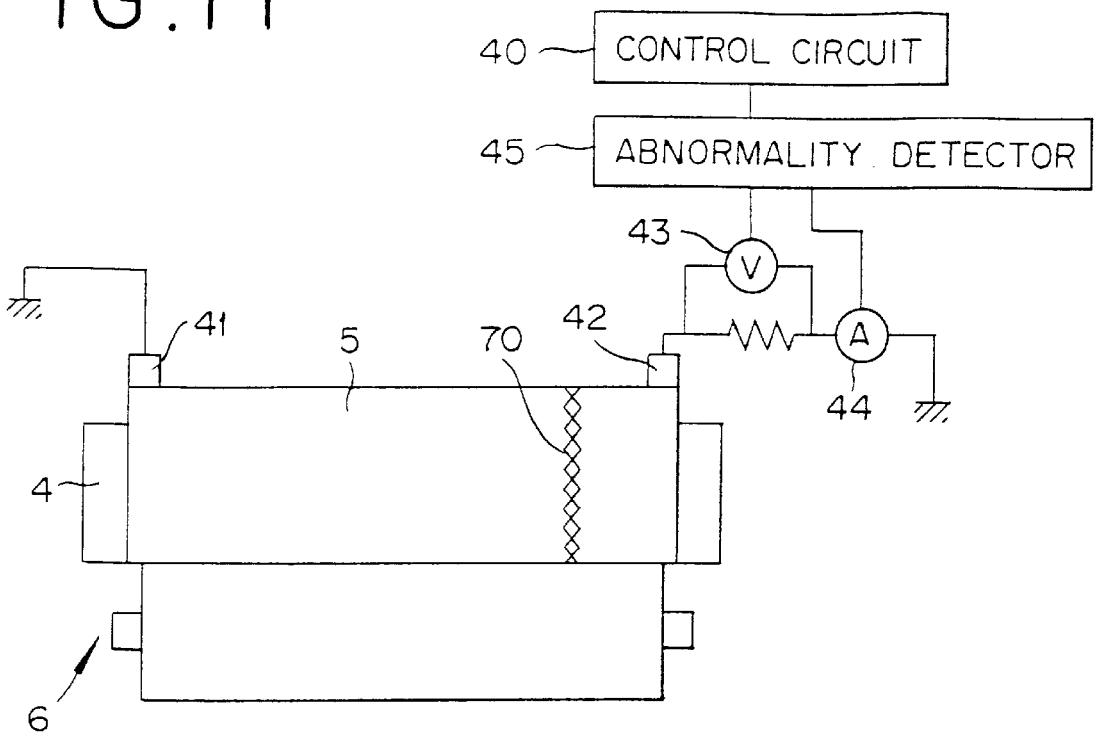
FIG. 11 is a diagram to aid in the description of a circuit for the detection of damage to a fixing sleeve in Example 4.

Further, this fixing unit is provided, as illustrated in FIG. 11, with electrodes 41 and 42 which contact the opposite ends of the sleeve 5. A feeble voltage is applied from the electrodes 41 and 42 to the sleeve 5. A damage, if any, sustained by the sleeve 5 is detected on the basis of changes in the applied voltage and the current.

The electrodes 41 and 42 are brush electrodes which avoid doing any harm to the sleeve 5 and remain constantly in contact with the sleeve 5. The applied voltage is only required to be in the approximate range of 0.1–5 V. This voltage is detected with a voltmeter 43 and the magnitude of current is detected with an ammeter 44. Based on the outcomes of these detections, an abnormality detector 45 determines the electric power (the electric power applied by the electrodes 41 and 42) flowing through the sleeve 5. When the electric power widely fluctuates, the abnormality detector 45 compares the amount of this fluctuation with the predetermined value, discerns the fluctuation as abnormality, and issues an instruction to a control circuit 40. This control circuit 40, on receiving the instruction on abnormality, stops the operation of the pressure roller 6 following the rotation of the sleeve 5 and, at the same time, stops the supply of the high-frequency current from the high-frequency power source (such as, for example, the circuit shown in FIG. 2 in Example 1 described above) to the coil 2.

Figure 12:
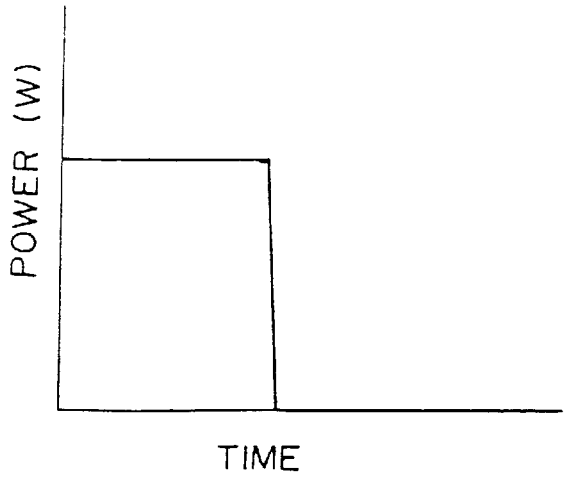
FIG. 12 is a diagram showing the time-course change of the electric power determined by the circuit for the detection of damage to the fixing sleeve in Example 4.

FIG. 12 shows the time-course change in the consumed power of the electric current flowing between the electrodes 41 and 42. If the sleeve 5 sustains a scratch in the circumferential direction like a scratch 70 illustrated in FIG. 11, the electric power begins to fall abruptly at the time of occurrence of the scratch 70. This abrupt fall of the electric power clearly tells the occurrence of the scratch on the sleeve 5.

EXAMPLE 5

While Examples 1–3 each concerns the fixing unit which effects the temperature control of the sleeve by resorting to the determination of the electric power of the coil, Example 5 concerns the fixing unit which effects the detection of abnormality of the sleeve by resorting to the determination of the electric power of the coil. The remaining components of the fixing unit of Example 5 are identical with those described in Example 4 with reference to FIG. 10 and will be omitted from the following description.

Figure 13:
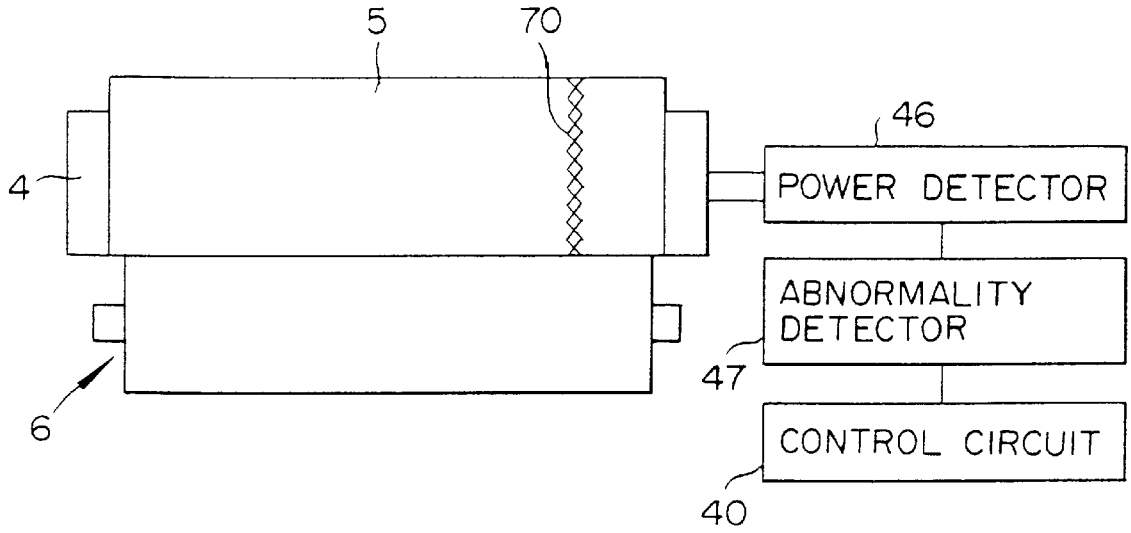
FIG. 13 is a diagram to aid in the description of a circuit for the detection of damage to a fixing sleeve in Example 5 embodying this invention.

Example 5, as illustrated in FIG. 13, aims to detect the scratch 70 on the sleeve 5 by installing next to the sleeve 5 a power detector 46 adapted to detect the electric power consumed in the coil 2 for generating an induced current in the sleeve 5 and allowing discernment of the scratch 70 based on a fluctuation of the power detected by the power detector 46. The detection of the consumed power is specifically attained by calculating the electric power based on the current flowing through the coil 2 and the voltage currently applied.

The principle which underlies the detection of a scratch on the sleeve will be described below.

Figure 14:
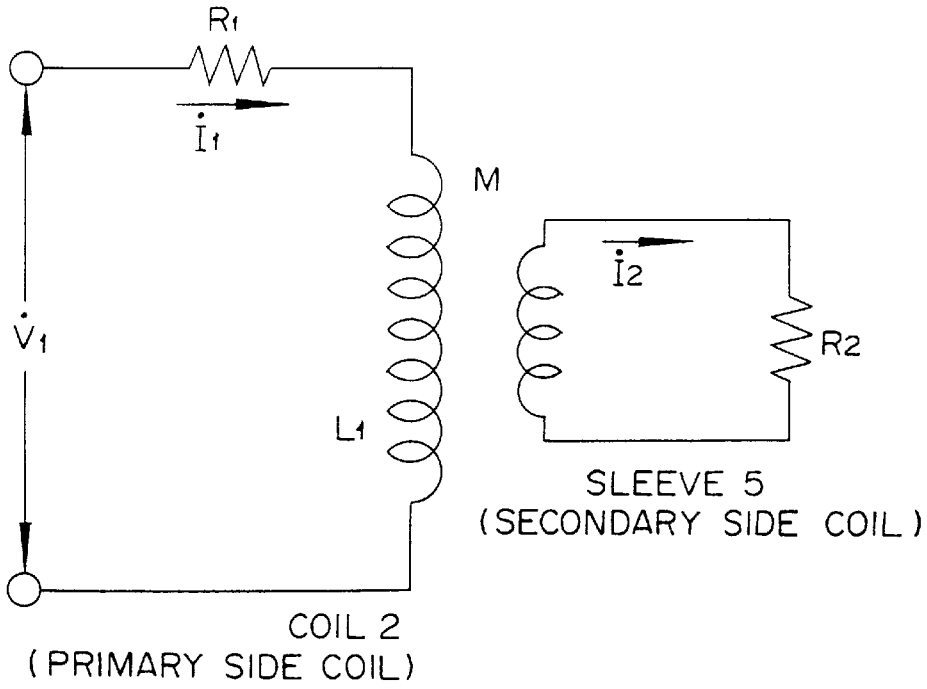
FIG. 14 is an equivalent circuit for electromagnetic induction heating.

The high-frequency induction heating resembles a transformer in fundamental principle. In the equivalent circuit thereof, the coil 2 corresponds to the primary side coil (N wind) and the sleeve 5 to the secondary side coil (1 wind) as illustrated in FIG. 14.

The high-frequency induction heating, therefore, satisfies the relations of the following formulas. In these formulas, $V_1$ stands for the voltage applied to the coil 2 (primary side coil), $I_1$ for the current flowing through the coil 2 (primary side coil), $R_1$ for the effective resistance of the coil 2 ( primary side coil), $L_1$ for the inductance of the coil 2 (primary side coil), $V_2$ for the voltage due to the induced electromotive force of the sleeve 5 (secondary side coil), $I_2$ for the current flowing through the sleeve 5 (secondary side coil) , $R_2$ for the effective resistance of the sleeve 5 (secondary side coil), $L_2$ for the inductance of the sleeve 5 (secondary side coil), M for the mutual inductance between the coil 2 and the sleeve 5, and k for the coupling coefficient (providing that $V_1$, $V_2$, $I_1$, and $I_2$ are severally expressed in vector quantities).

$$V_1=(R_1+j\omega L_1)I_1+j\omega MI_2 \quad (1)$$

$$O=j\omega MI_1+(R_2+j\omega L_2)I_2 \quad (2)$$

$$k = M / \sqrt{L_1 L_2} \quad (3)$$

From the formulas given above, the impedance Z of the circuit as viewed from the primary side, namely the coil 2, can be found as follows.

$$Z=V_1/I_1=R_1+j\omega L_1+(\omega M)^2/(R_2+j\omega L_2)=R_1+\{(\omega M)^2R_2\}/\{R_2^2+(\omega L_2)^2\}+j\omega[L_1-\{(\omega M)^2L_2\}/\{R_2^2+(\omega L_2)\}^2] \quad (4)$$

It is noted from the formula (4) that when a scratch occurs on the sleeve 5 on the secondary side and consequently causes changes in $R_2$, $L_2$, and M, the electromagnetic coupling between the coil 2 and the sleeve 5 produces a proportionate change in the impedance Z on the primary side. By monitoring the electric power of the coil 2 on the primary side, therefore, an abnormality in the sleeve 5 on the secondary side can be detected.

Figure 15:
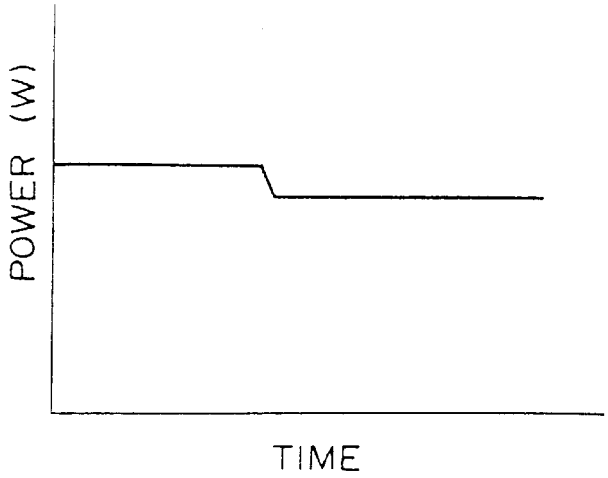
FIG. 15 is a diagram showing the time-course change of electric power consumed by a coil 2 determined by the circuit for the detection of damage to the fixing sleeve in Example 5.

FIG. 15 depicts the time-course change in the actual state of the electric power of the coil 2. It is noted from this diagram that the electric power of the coil 2 begins to fluctuate at the time that the sleeve 5 sustains the scratch 70. By detecting this fluctuation in the electric power, therefore, the occurrence of a scratch on the sleeve 5 can be discerned.

The electric power detected by the power detector 46 as described above enables an abnormality detector 47 to determine whether or not the fluctuation in the electric power of the coil 2 is abnormal. When the abnormality is discerned, the control circuit 40 which has received a signal indicating the abnormality from the abnormality detector 47 stops the operation of the pressure roller 6 keeping the sleeve 5 in sympathetic rotation and, at the same time, stops the supply of the high-frequency current from the high-frequency power source (such as, for example, the circuit illustrated in FIG. 2 in Example 1 described above) to the coil 2.

The reason for effecting the detection of the scratch of the sleeve 5 by detecting the electric power, namely by finding the electric power by measuring both the magnitude of current flowing to the coil 2 and the relevant magnitude of voltage is that by the measurement of either of the magnitude of current and the magnitude of voltage, it is difficult to discriminate between the fluctuation of the voltage of the high-frequency power source and the change in the voltage or the current due to the scratch of the sleeve S. In this respect, since the electric power has the current thereof increased in accordance as the voltage thereof decreases and decreased in accordance as the voltage thereof increases, the electric power, when introduced, is allowed to assume a predetermined constant magnitude. A fluctuation from this fixed magnitude, therefore, can be referred to the scratch on the sleeve 5 and not to the influence of the power source.

EXAMPLE 6

Example 6 concerns one modification that can be applied to Examples 1–5 described above.

Figure 16:
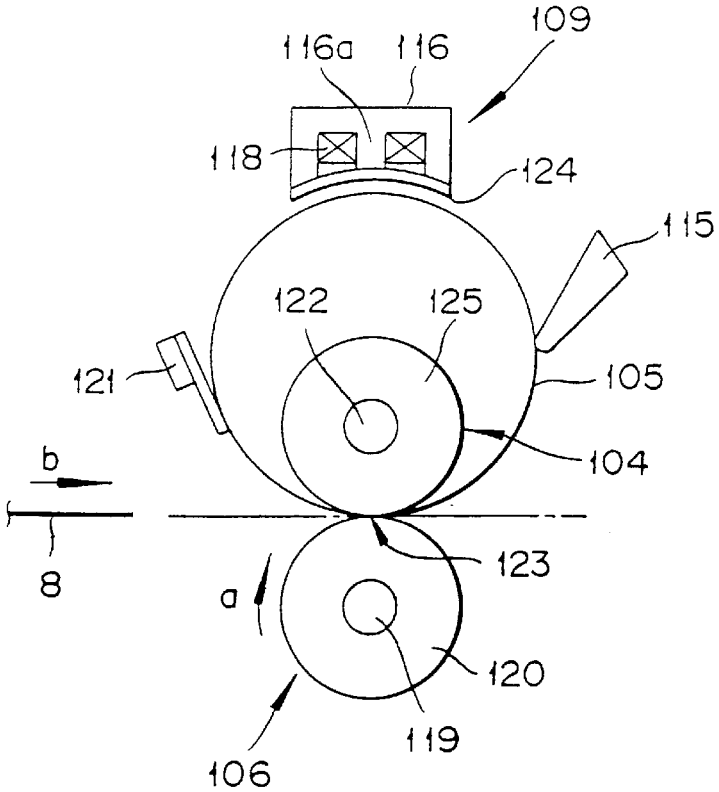
FIG. 16 is a schematic cross section illustrating a fixing unit of Example 6 embodying this invention.

FIG. 16 is a cross section illustrating schematically a fixing unit according to Example 6.

The fixing unit illustrated in FIG. 16, similarly to those of Examples 1–5 described above, is aimed at causing an unfixed image formed with a developer such as a toner on a sheet 8 in conveyance to be thermally fused by the induction heating technique and fixed on the sheet 8. This fixing unit is composed of a coil assembly 109 adapted to generate a high-frequency magnetic field, a metallic sleeve 105 adapted to generate heat by virtue of the induction heating effected by the coil assembly 109 and disposed rotatably, a rotatable internal pressure roller 104 adapted to collide against the inner surface of the sleeve 105, and a rotatable external pressure roller 106 opposed to the internal pressure roller 104 and adapted to collide against the outer face of the sleeve 105.

The external pressure roller 106 is disposed as enabled to rotate in the direction of an arrow mark a in FIG. 16 and the sleeve 105 is nipped between the external pressure roller 106 and the internal pressure roller 104 and rotated by following the rotation of the external pressure roller 106.

A sheet 8 having an unfixed toner image transferred thereto is conveyed from the direction of left as indicated by an arrow b in FIG. 16 and advanced toward a nip part 123 destined to nip the sheet 8. The sheet 8 is conveyed through the nip part 123 as exposed meanwhile to the heat of the sleeve 105 in a heated state and to the pressure exerted by the two pressure rollers 104 and 106. As a result, the unfixed toner is fixed and a fixed toner image is formed on the sheet 8. The sheet 8 which has passed the nip part 123 is separated from the sleeve 105 either spontaneously by virtue of the radius of curvature of the sleeve 105 or by means of a separation claw 115 adapted to collide against the surface of the sleeve 105 and then conveyed in the direction of right in FIG. 16. The sheet 8 is conveyed by a paper discharge roller not shown in the diagram and discharged onto a discharged paper tray.

The sleeve 105 is a flexible thin-wall hollow metallic conductor which contains a conducting layer formed of such a conducting magnetic material as nickel, iron, or SUS 430. The sleeve 105 has formed on the peripheral surface thereof a heat-resistant release layer resulting from the application of fluorine resin. The sleeve 105 has a wall thickness in the range of 20 $\mu$m–60 $\mu$m.

Example 6 particularly has the coil assembly 109 which is disposed outside the sleeve 105 as opposed to the outer face thereof and adapted to heat the sleeve 105 by inducing the sleeve 105 to allow flow of an induced current (eddy current) and generate Joule heat. This coil assembly 109 is supported by a holder not shown in the diagram and fixed to a fixing unit frame as opposed to the outer face of the sleeve 105 across a prescribed gap. As a result, the coil and the vicinity thereof are prevented from being heated when the self-heating of the coil and the core disposed inside the sleeve and the radiation of heat to the inner face of the relevant heating medium result in the growth of heat concentration. Further, since the coil assembly 109 is disposed outside the sleeve 105, the thermal energy arising from the generation of heat by the coil itself is diffused and the coil is consequently cooled spontaneously.

The coil assembly 109 comprises a core 116 having a cross section of the shape roughly of a letter E and a coil 118 formed by winding a copper wire several turns around a central leg part 116*a* through the medium of an insulating member not shown in the diagram and adapted to generate a high-frequency magnetic field necessary for inducing the sleeve 105 to flow an induced current.

Figure 17:
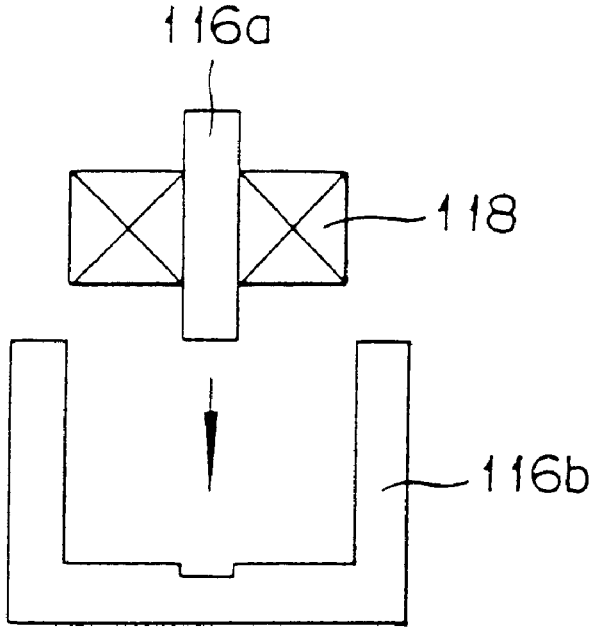
FIG. 17 is an exploded front view of a coil assembly shown in FIG. 16.

The coil 118 is preferred to be a simple or litz copper wire which is provided on the surface thereof with a fused layer and an insulating layer. The core 116, as illustrated in FIG. 17, is constructed as divided into a central leg part 116*a* having a cross section of the shape roughly of a letter I and allowing the coil 118 to be wound thereon and an outer edge part 116*b* having a cross section of the shape roughly of three sides of a square and provided with an outer leg part. The central leg part 116*a* and the outer edge part 116*b* are formed of a ferrite core or laminate core which is a magnetic material and they both form magnetic paths for the magnetic fluxes generated by the coil 118. Owing to the formation of these magnetic paths, the leakage of magnetic fluxes is depleted and the efficiency of heating is exalted.

Since the core 116 having a cross section of the shape roughly of a letter E is divided into the central leg part 116*a* and the outer edge part 116*b* as described above, the manufacture of the coil assembly 109 is attained very easily by first winding the coil 118 several turns around the central leg part 116*a* and inserting the coil 118 in the ensuant state in the direction of an arrow in the diagram into the outer edge part 116*b*. As a result, the possibility of inflicting damage on the copper wire of the coil or peeling the insulating layer can be infallibly prevented.

Figure 18:
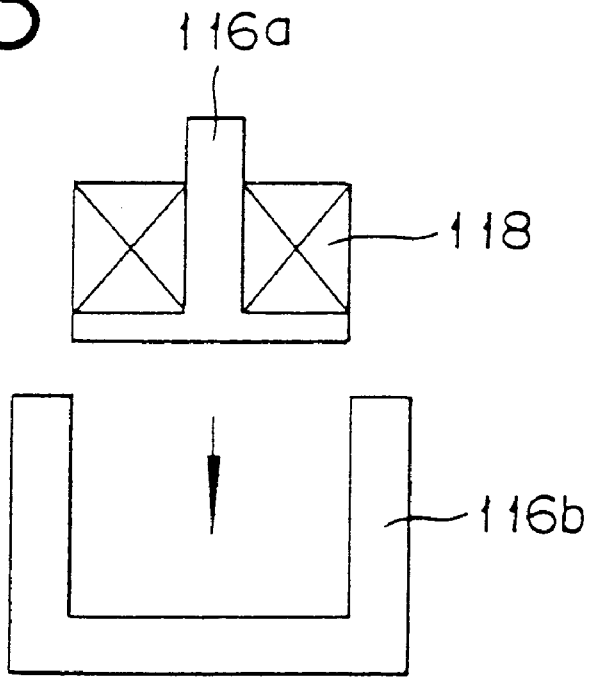
FIG. 18 is an exploded front view illustrating a further version of the coil assembly.

The construction of this coil assembly 109, besides that illustrated in FIG. 17, may be such that the leg part 116*a* has a cross section of the shape roughly of a letter T as illustrated in FIG. 18, for example. This construction renders it easy to prevent the coil from disintegration. Incidentally, the coil assembly which is provided with the divisible core having a cross section of the shape roughly of a letter E can be used not only for the fixing unit illustrated in FIG. 16 but also for an arbitrary induction heating type fixing unit.

Figure 19:
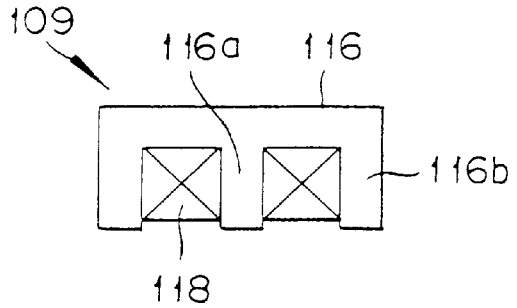
FIG. 19 is a front view illustrating another version of the coil assembly.
Figure 20:
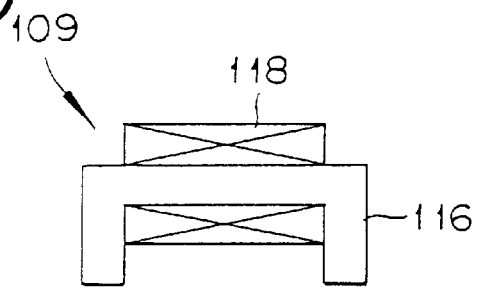
FIG. 20 is a front view illustrating yet another version of the coil assembly.

The coil assembly 109 is preferred to have the leading ends of the leg parts thereof paralleled to the outer face of the sleeve 105 as illustrated in FIG. 16 for the purpose of improving the efficiency of heating. It is, however, allowable to have the leading ends of the leg parts aligned in one plane as illustrated in FIG. 19. Alternatively, the coil assembly 109 can be easily and inexpensively constructed by forming the core 116 in a cross section of the shape roughly of three sides of a square and winding the coil 118 around the central part of the core 116 as illustrated in FIG. 20. The coil assembly 109 may be positioned as on the upstream side of the nip part 123 instead of above the sleeve 105 as illustrated in FIG. 16.

Figure 21:
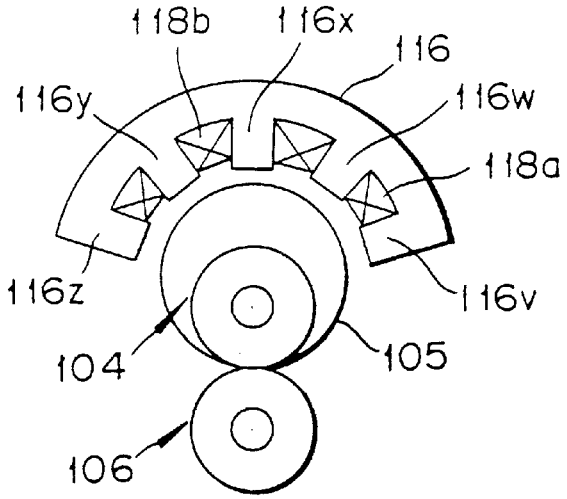
FIG. 21 is a front view illustrating still another version of the coil assembly.

It is also allowable to construct the coil assembly 109 in such a manner that the core 116 may be formed in a shape provided with a multiplicity of leg parts 116*v*–116*z* and the core 118 may be provided with a plurality of separated winding parts 118*a*, 118*b* as illustrated in FIG. 21. This construction enables necessary heating to be efficiently effected on a wide range, depending on the size of the sleeve 105. In this construction, the leg parts 116*w* and 116*y* each having a cross section of the shape roughly of a letter I are separated from the main body of the core and the adjacent winding parts 118*a* and 118*b* of the coil 118 are wound in the same direction respectively around the leg parts 116*w*, 116*y* and inserted in the resultant state into the main body of the core. The magnetic fluxes generated severally in the winding parts, accordingly, are prevented from canceling each other and are harnessed to generate induction heating and effect necessary heating efficiently.

The number of the separated winding parts does not need to be limited to two as illustrated in FIG. 21 but may be increased. It is permissible to install a plurality of such coil assemblies 109 as illustrated in FIG. 16 so as to provide necessary heating efficiently for a wide range.

A platelike insulating member 124 is disposed on the side opposite the sleeve 105 of the coil assembly 109 as illustrated in FIG. 16. The insulating member 124 appropriately is a foamed heat-resistant elastic member, for example. Specifically, foamed sponge rubber or foamed silicone rubber may be used as the material therefor. Such a heat-resistant porous material as a porous ceramic substance may be used instead. By this measure, the heat generated in the sleeve 105 can be prevented from diffusing into the ambience and, at the same time, the hot sleeve 105 can be prevented from applying heat to the coil assembly 109. As a result, the efficiency with which the sheet is heated can be improved and, at the same time, the rise of the temperature of the coil and the vicinity thereof can be further allayed.

In the place of the insulating member 124 mentioned above, a plate like member possessed of a low heat-radiating face whose thermal radiation coefficient, $\epsilon$, satisfies $0<\epsilon<0.6$ may be disposed on the side opposite the sleeve 105 of the coil assembly 109. Specifically, the thermal radiation coefficient $\epsilon$ can be set in the range of 0.3–0.4 by applying an aluminum-containing coating material to a plate formed of a nonmagnetic material or in the range of 0.2–0.3 by applying a zinc plating, for example. By giving a mirror finish to the plated surface, the thermal radiation coefficient $\epsilon$ can be greatly decreased to the order of about 0.06 (the coefficients mentioned herein invariably based on the assumption that the prevalent temperature is in the range of 120° C.–500° C.). The low heat-radiating face mentioned above, therefore, is enabled to lower the thermal radiation coefficient $\epsilon$ thereof even below the approximate lower limit, 0.6, which is obtained during the oxidation of iron or stainless steel which is generally used. The energy liberated from the heat of the hot sleeve 105 to the low heat-radiating face can be allayed to the extent of improving the efficiency of heating the recording member and preventing the rise of the temperature of the coil and the vicinity thereof. Optionally, the low heat-radiating face mentioned above maybe formed on the terminal face opposed to the sleeve 105 of the insulating member 124.

The internal pressure roller 104 and the external pressure roller 106, both assuming the shape of a roller, are composed respectively of cores 122 and 119 and surface release type heat-resistant silicone rubber layers 125 and 120 formed around the cores 122 and 119. Thus, they can be supported rotatably by the cores 122 and 119 and can transmit the rotary drive force thereof. Optionally, such a material as sponge which has small thermal capacity may be used instead for the layers 125 and 120. It is allowable to cover the outer faces of the pressure rollers 104 and 106 with a thin-wall tube made of fluorine resin.

The cores 122 and 119 are formed of a hollow core metal. When the pressure rollers 104 and 106 are enlarged in diameter for the purpose of widening the nip width, they tend to gain in thermal capacity. By forming the cores 122 and 119 in the hollow construction, however, the thermal capacity of the pressure rollers 104 and 106 can be lowered and the diffusion of the heat used for the fixation of the toner image can be allayed. The hollow parts of the cores 122 and 119 are preferred to be vacuumized for further lowering the thermal capacity of the pressure rollers 104 and 106.

The external pressure roller 106 is so constructed as to be rotated in the direction of an arrow a shown in FIG. 16. The sleeve 105 is nipped between the external pressure roller 106 and the freely rotatable internal pressure roller 104 and is rotated by following the rotation of the external pressure roller 106. Since the sleeve 105 is adapted to be conveyed as nipped between the external pressure roller 106 and the internal pressure roller 104 which are kept in rotation, it is prevented from sustaining abrasion or deformation from the slide contact. Optionally, the internal pressure roller 104 may be adapted to be driven by rotation and consequently the external pressure roller 106 may be rotated by following the rotation of the internal pressure roller 104.

Thus, according to Example 6, since the coil assembly 109 is disposed outside the sleeve 105 as opposed to the outer face thereof, the situation in which the temperature of the coil and the vicinity thereof is greatly increased owing to the self-heating of the coil 118 and the core 116 and the radiation of heat to the inner face of the sleeve 105 can be precluded. This fact contributes to lower the cost of the heating device because the necessity for using a material unduly excelling in heat resistance at elevated temperatures for the covering of the coil and the peripheral members thereof is obviated. Further, since the sleeve 105 is conveyed in concert with the sheet 8 as nipped between the external pressure roller 106 and the internal pressure roller 104 which rotate, the possibility of the sleeve 105 sustaining such defects as abrasion and deformation owing to the contact slide can be eliminated.

EXAMPLE 7

Example 7 constitutes another modification which can be applied to Examples 1–5 described above.

Figure 22:
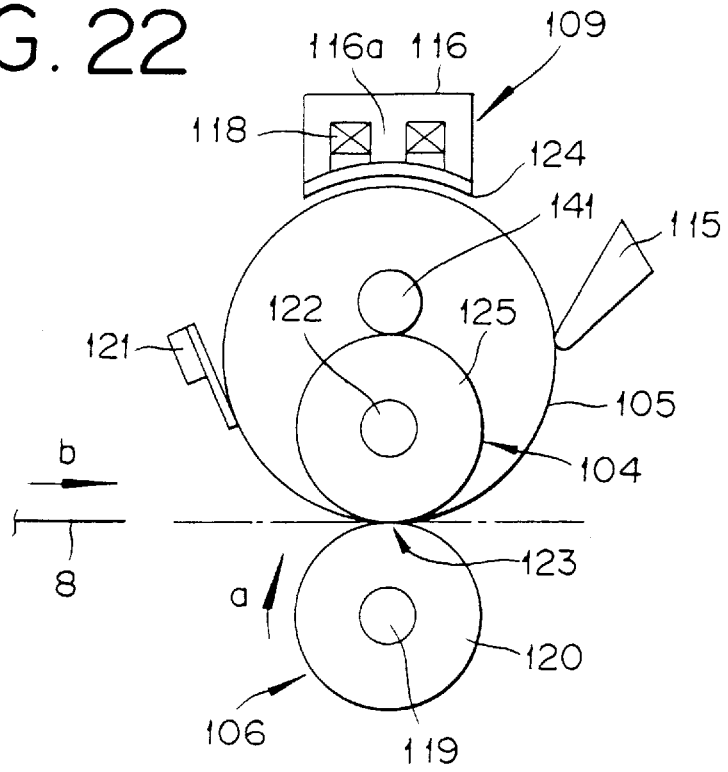
FIG. 22 is a schematic cross section illustrating a fixing unit of Example 7 embodying this invention.

FIG. 22 is a cross section schematically illustrating a fixing unit according to Example 7. In the diagram, like members found in Example 6 are denoted by like reference numerals. Example 7 differs from Example 6 particularly in respect that a heat-diffusing member 141 possessed of good thermal conductivity is adapted to collide against the internal pressure roller 104.

The heat-diffusing member 141 illustrated in FIG. 22 assumes a cylindrical shape. Owing to the contact of the outer face thereof with the internal pressure roller 104, it is rotated by following the rotation of the internal pressure roller 104. The heat-diffusing member 141 is preferred to be formed in a relatively elongate shape possessed of the same length as the size of the internal pressure roller 104 along the longitudinal direction thereof. Optionally, a plurality of heat-diffusing members each of a relatively small length may be arrayed along the longitudinal direction of the internal pressure roller 104 on the condition that they realize good heat conduction in the longitudinal direction.

The heat-diffusing member 141 is preferred to possess good thermal conductivity. Specifically, it is formed of aluminum, silver, copper, or any of the alloys thereof. It is also allowable to use a ceramic member vested with exalted thermal conductivity or a so-called heat pipe for constructing the heat-diffusing member 141. The heat-diffusing member 141 has the material therefor selected and the cross-sectional area thereof decided so as to acquire a prescribed thermal conductivity.

Since the heat-diffusing member 141 which collides with the internal pressure roller 104 is formed of a material featuring good thermal conductivity, the conduction of heat in the longitudinal direction to the sleeve 105 through the medium of the internal pressure roller 104 is improved and the conduction of heat of the sleeve 105 in the longitudinal direction is facilitated. Even in the mode for continuously passing sheets 8 of a smaller size than the maximum width of paper passage, therefore, the heat in the area allowing no passage of paper is conducted through the internal pressure roller 104 and the heat-diffusing member 141 to the paper-passing area and the difference between the temperature in the paper-passing area of the sleeve 105 and the temperature in the area allowing no passage of paper is decreased. Since the rise of temperature in the area allowing no passage of paper is allayed and the uneven distribution of temperature in the longitudinal direction of the sleeve 105 is repressed, the possibility that the peripheral members such as the separation claw 115 which are made of resinous materials will suffer a decrease in service life in the heated state or sustain thermal damage is eliminated. Even when the sheets 8 of a large size are passed immediately after the termination of the mode mentioned above, the fixing property will suffer no partial loss of evenness and the high-temperature offset will be precluded.

Figure 23:
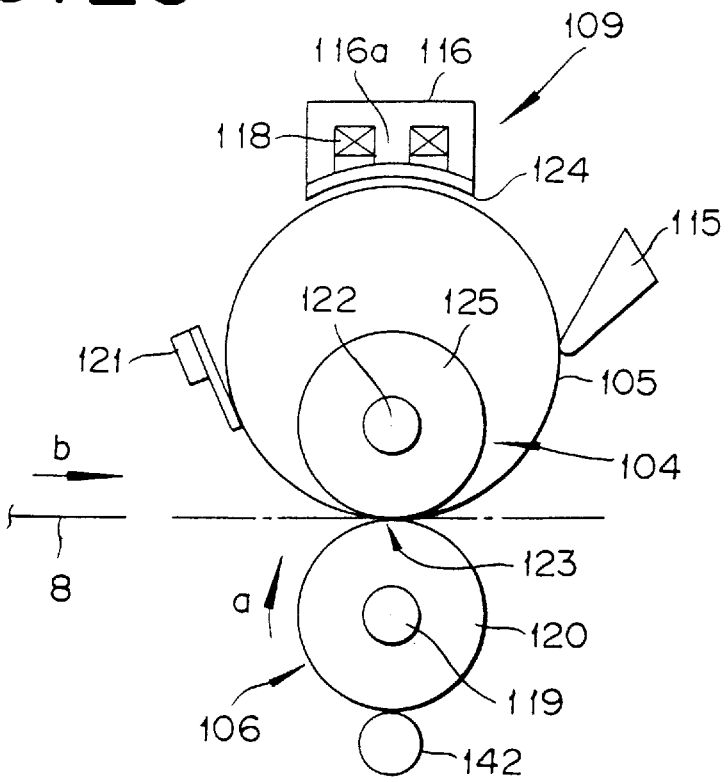
FIG. 23 is a schematic cross section illustrating an example of the modification of the fixing unit of FIG. 22.

Thus, according to Example 7, it is made possible to repress the temperature fluctuation in the longitudinal direction of the sleeve 105 in the heated state and realize a stable fixing property in any of the modes of paper passage. Optionally, a heat-diffusing member 142 possessed of the same good thermal conductivity as mentioned above may be adapted to collide with the external pressure roller 106 as illustrated in FIG. 23.

EXAMPLE 8

Example 8 is yet another modification which is applicable to Examples 1–5 described above.

Figure 24:
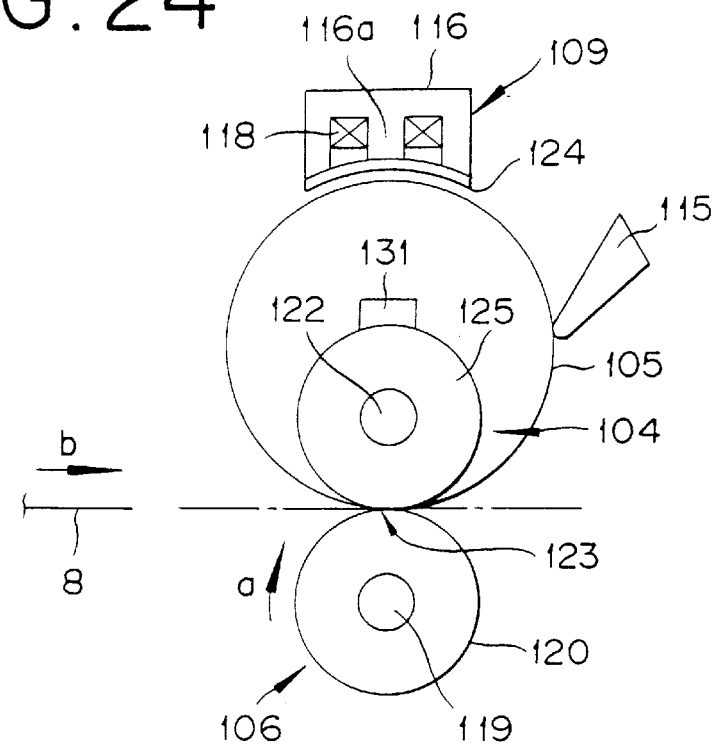
FIG. 24 is a schematic cross section illustrating a fixing unit of Example 8 embodying this invention.

FIG. 24 is a cross section schematically illustrating a fixing unit according to Example 8. In this diagram, like members found in Example 6 are denoted by like reference numerals. Example 8 differs from Example 6 particularly in respect that it has a temperature sensor 131 for detecting temperature adapted to collide against the internal pressure roller 104, whereas Example 6 has the temperature sensor 121 adapted to collide against the sleeve 105.

Figure 25:
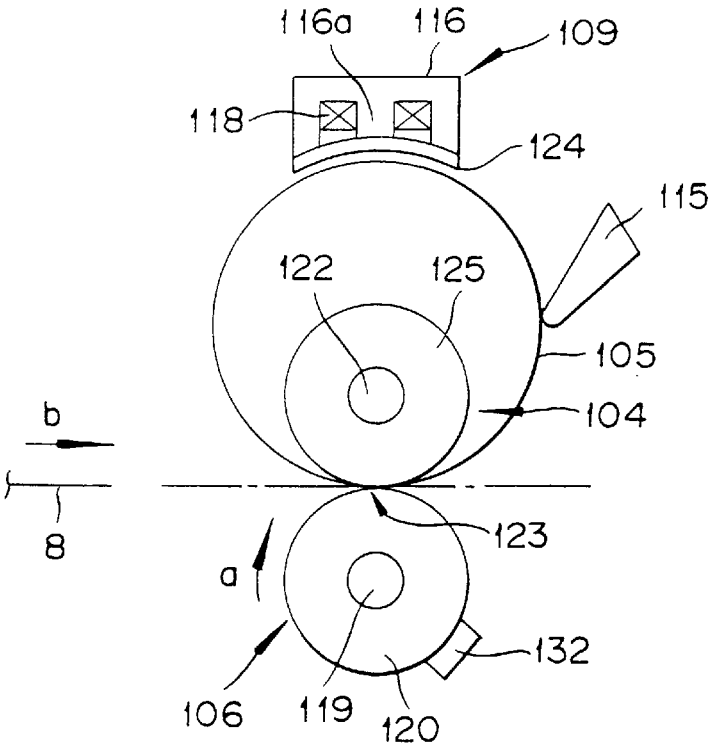
FIG. 25 is a schematic cross section illustrating an example of the modification of the fixing unit of FIG. 24.

According to Example 8, the temperature sensor 131 collides easily against the internal pressure roller 104 as compared with the sleeve 105 having a small wall thickness and the control of temperature can be attained by the infallible collision of the temperature sensor 131. In this case, however, the surface of the internal pressure roller 104 requires to possess fairly satisfactory thermal conductivity. Optionally, the temperature sensor 132 may be adapted to collide against the external pressure roller 106 as illustrated in FIG. 25.

EXAMPLE 9

Example 9 is still another modification which is applicable to Examples 1–5 described above.

Figure 26:
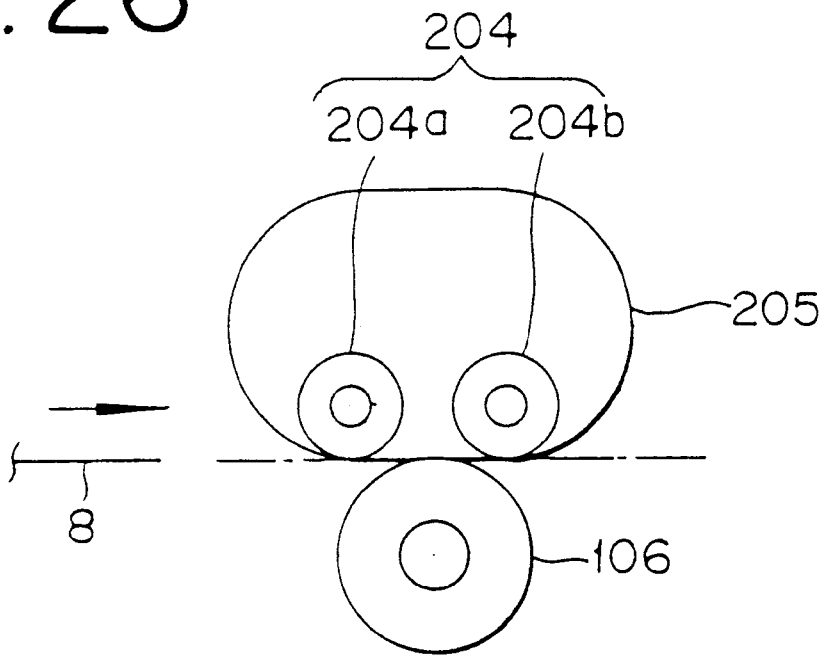
FIG. 26 is a schematic cross section illustrating a fixing unit of Example 9 embodying this invention.

FIG. 26 is a cross section schematically illustrating a fixing unit according to Example 9. In this diagram, like members found in Example 6 are denoted by like reference numerals. In FIG. 26 and in FIG. 27 which will be described herein below, the coil assembly, the separating claw, the temperature sensor, etc. are omitted from illustration. Example 9 differs from Example 6 particularly in respect that it has an internal pressure roller 204 which is composed of two rollers 204*a* and 204*b*.

According to Example 9, since the range in which the sheet 8 and the developing agent are heated by the sleeve 205 becomes wide, the heating time for the sheet 8 can be elongated, the fixing temperature can be set at a lower level, and the thermal efficiency can be exalted. Moreover, since the rollers 204*a* and 204*b* can be decreased in diameter without securing the wide heating range mentioned above, it is made possible to lower the thermal capacity of the internal pressure roller 204 and repress the wasteful diffusion of the heat of the sleeve 205.

Figure 27:
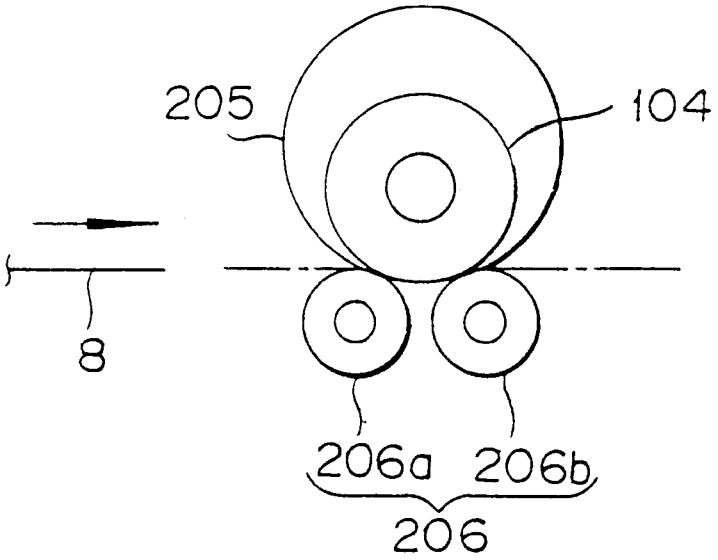
FIG. 27 is a schematic cross section illustrating an example of the modification of the fixing unit of FIG. 26.

Optionally, an external pressure roller 206 may be formed of two rollers 206*a* and 206*b* while using one internal pressure roller 104 as illustrated in FIG. 27.

Of course, it is permissible to form such pressure rollers 204 or 206 severally with a larger number of rollers than are illustrated.

EXAMPLE 10

Example 10 is still another modification which is applicable to Examples 1–5 described above.

Figure 28:
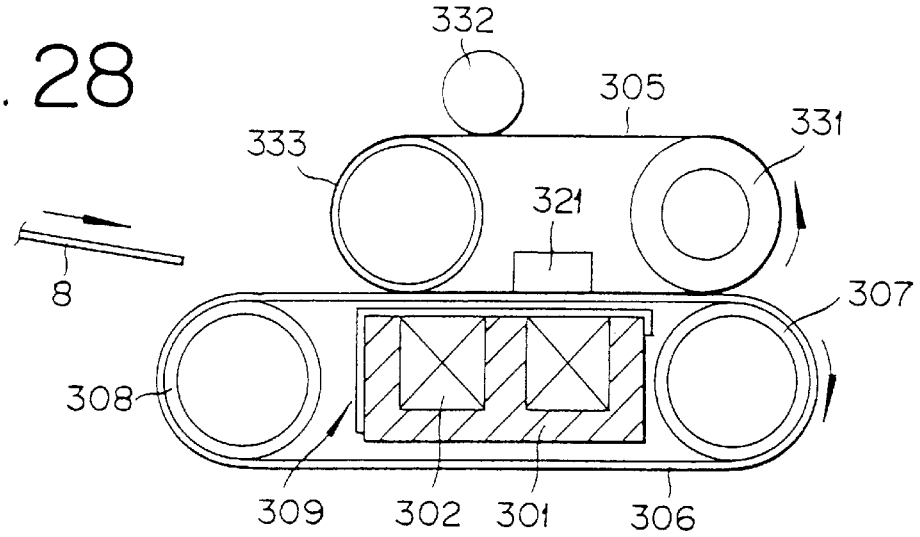
FIG. 28 is a schematic cross section illustrating a fixing unit of Example 10 embodying this invention.

FIG. 28 is a cross section schematically illustrating a fixing unit according to Example 10.

The electromagnetic induction heating type fixing unit of FIG. 28 which is intended to be incorporated in a copying machine or printer (hereinafter referred to as "main body of machine") is provided with a belt 305 possessed of conductivity.

This belt 305 is suspended as passed around a drive roller 331 and a tension roller 333 and is vested with prescribed tension. The drive roller 331 is formed of a heat-resistant rubber roller and rotated counterclockwise in the bearings of FIG. 28 by the drive force supplied from the main body of machine. By the rotation of this drive roller 331, the belt 305 is advanced.

A colliding belt 306 having a greater peripheral length than the belt 305 is disposed in such a manner that the outer faces of these two belts 305 and 306 may contact each other. This colliding belt 306 is suspended as passed around a drive roller 307 and a tension roller 308. The drive roller 307 is rotated clockwise in the bearings of FIG. 28 in such a manner that the peripheral speeds of the belts 305 and 306 coincide with each other. As a result, the recording member 8 which is fed into the gap between the two belts 305 and 306 can be stably conveyed and the recording member 8 is heated as held in intimate contact with the two belts 305 and 306 and the efficiency of heat conduction to the recording member 8 is exalted.

Figure 29:
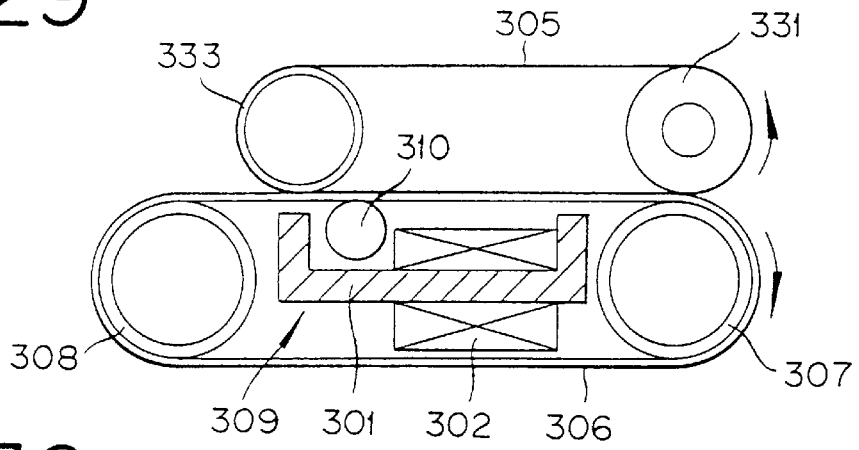
FIG. 29 is a cross section schematically illustrating the construction of a fixing unit incorporating therein a pressure roller for pressing a fixing belt and a contact belt into mutual contact.

Optionally, a pressure roller 310 intended as a pressure member for pressing the belt 305 and the colliding belt 306 against each other maybe disposed halfway in the entire length of the path between the points at which the recording member 8 is conveyed into and out of the belt 305 as illustrated in FIG. 29. The sheet 8 is pressed to a certain degree by the tensions of the belts 305 and 306. If the tensions are unduly large, they increase the drive torque for rotating the drive roller, exert a large load on the drive source such as a motor and degrade the efficiency thereof, and constitute the stress in the belt and shorten the service life of the belt. When a member adapted to press the developing agent together with the recording member during the course of heating is provided separately of the belts, it enables good heat conduction to be effected without any recourse to the tensions of the belts and allows an addition to the efficiency of heat conduction.

As an induction heating source for effecting necessary heating by inducing the belt 305 to produce an induced current, a coil assembly 309 comprising a core 301 and a coil 302 wound around the core 301 is disposed inside the colliding belt 306 as opposed to the belt 305 across the passage for the recording member 8 as illustrated in FIG. 28. The colliding belt 306 has a greater peripheral length than the belt 305.

Since the heating device enables the portion of the belt 305 which is opposed to the recording member 8 to generate heat directly, it is at an advantage in decreasing the heat loss, lowering the thermal capacity, and consequently curtailing the time required for the heat-generating part to reach the preset fixing temperature. Further, since the heating device allows greater freedom for the selection of the size of the coil 302 and enables the belt 305 to generate heat in a wider range. The self loss of the coil itself (the copper loss of the coil or the iron loss of the core, for example) can be allayed by giving the coil 302 an amply large size.

The basis of the belt 305 mentioned above is a magnetic material (such as, for example, nickel, iron, cobalt, or any of the alloys thereof). This belt 305 has formed on the surface thereof a heat-resistant release layer or a heat-resistant rubber layer. The term "magnetic material" as used herein refers to a relevant substance having specific permeability of not less than about 100. When the magnetic material has large specific permeability, the belt 305 absorbs magnetic fluxes generated by the coil 302 and gains in magnetic flux density and allows the heating to be effected with high efficiency.

The belt 305 is preferred to be an electrically cast belt using nickel or a nickel-iron alloy as its basis. Since the belt face is liable to affect the image being fixed, this belt 305 is preferred to have an endless construction. The nickel or nickel-iron alloy as a basis can be manufactured by electrical casting into an endless belt of high heating efficiency whose basis is the magnetic material and can contribute to lower the cost of production.

Figure 30:
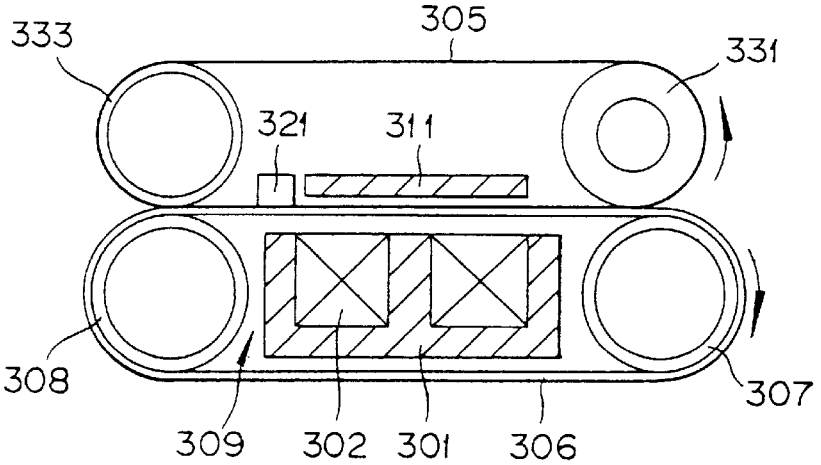
FIG. 30 is a cross section schematically illustrating the construction of a fixing unit provided on the inner side of the fixing belt with a magnetic member.

Optionally, a magnetic member 311 adapted to increase the magnetic fluxes from the coil 302 may be disposed inside the belt 305 as illustrated in FIG. 30. The magnetic member 311 is formed of a plate of ferrite, for example. As a result, it allows an increase in the magnetic fluxes generated by the coil 302 and exalt the efficiency of heating, consequently allows a decrease in the size of the coil 302, and enables the fixing belt to be quickly heated to a prescribed temperature.

The basis for the colliding belt 306 is a conducting material and, therefore, absorbs the magnetic fluxes to a certain degree, and generates heat. Since the recording member 8 being passed between the two belts 305 and 306 is heated from above and below, it is heated efficiently enough for permitting the necessary fixation to be attained by a brief nipping. When the recording member is paper, the amount of curl suffered to occur therein can be decreased.

The coil assembly 309 is disposed so as to be separated by a fixed distance from the inner face of the colliding belt 306 and is fixed to the main body of machine or to the shell of the fixing unit not shown in the diagram. This coil assembly 309 is provided with a core 301 and a coil 302. By the high-frequency current flowing to the coil 302, the belt 305 generates an induced current and the belt 305 generates heat.

The coil 302 is formed by winding a plurality of turns a copper wire having a fused layer and an insulating layer superposed, for example, on the surface. The core 303 is formed of a ferrite core or a laminated core, for example.

An oil-applying roller 332 is disposed in such a manner that the peripheral face thereof may contact the belt 305. The part of the belt 305 which has passed the nip part is coated with an oil capable of releasing the toner by means of the oil-applying roller 332 by the time that it is conveyed again to the heating part. This oil-applying roller 332 is supported by a holder not shown in the diagram and is rotated by following the motion of the belt 305. The surface of the oil-applying roller 332 is formed of a felt-like member and consequently is enabled to manifest the effect of removing the toner adhering to the surface of the belt 305 from this belt 305 in consequence of the rotation mentioned above. The holder mentioned above is so constructed that the user of the heating device is enabled to attach or detach the oil-applying roller 332 in conjunction with the holder.

Inside the belt 305, a temperature sensor 321 for detecting the temperature of the colliding belt 305 is set in place. This temperature sensor 321 is formed of a thermistor, for example, pressed against the inner face of the heat-generating part of the belt 305, operated to detect the temperature of the belt 305 with the thermistor, and controls the supply of electricity to the coil 302 so as to optimize the temperature of the belt 305.

Now, the operation of Example 10 will be explained below.

The flow of a high-frequency electric current to the coil 302 of the coil assembly 309 disposed inside the colliding belt 306 opposite the belt 305 mentioned above across the passage for the recording member 8 gives rise to magnetic fluxes to be supplied to the belt 305. The magnetic fluxes are passed through the non-conducting recording member and absorbed by the belt 305 and spent for the generation of an eddy induced current. Consequently, the belt 305 generates heat owing to the specific resistance of its own.

The sheet 8 having a toner image transferred thereto is conveyed from the direction of left in the bearings of FIG. 28, guided into the gap between the two belts 305 and 306, forwarded into the tightly joined parts of the belt 305 and the colliding belt 306, and enabled to fix the toner image formed thereon by virtue of heat and pressure. The sheet 8 is enabled to finalize the fixation of the toner image thereon in the part thereof which is pressed between the drive rollers 331 and 307 by virtue of the large pressure and the retained heat. The sheet 8 which has departed from the tightly joined parts mentioned above is guided by a guide member not shown in the diagram and discharged.

According to Example 10, since the coil assembly 309 including the coil 302 is disposed as opposed to the belt 305 mentioned above across the passage for the recording member 8, the coil 302 is allowed a great freedom of choice of its size, the belt 305 is enabled to generate heat in a wide range, and consequently the recording member 8 is enabled to be heated in a wide range. As a result, the heating time for the recording member 8 can be elongated, the fixing temperature can be set at a lower level, and the thermal efficiency can be exalted.

Since the heating time is long, the fixing temperature is low, and the diffusion of heat is small as described above, the heating device may be so controlled that the heating of the belt 305 may be started either simultaneously with or immediately before the entry of the recording member 8 into the belt 305 and, at the same time, the heating of the belt 305 may be stopped either simultaneously with or immediately after the departure of the recording material from the belt 305. As a result, the fixing operation can be attained while omitting the heating in case of no need and the consumption of energy can be decreased.

The self loss of the coil itself can be allayed by giving the coil 302 an ample size.

EXAMPLE 11

Example 11 is yet another modification which is applicable to Examples 1–5 described above.

Figure 31:
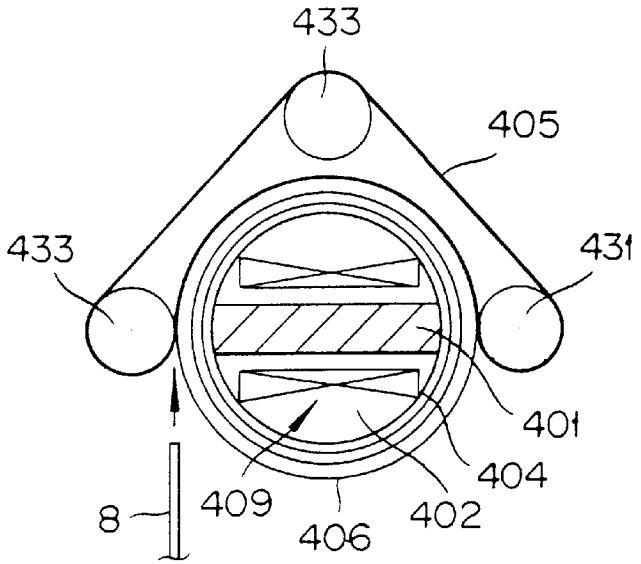
FIG. 31 is a schematic cross section illustrating a fixing unit of Example 11 embodying this invention.

FIG. 31 is a cross section schematically illustrating the construction of a fixing unit according to Example 11.

The fixing unit illustrated in FIG. 31 is provided with a roller 406 adapted to collide against a belt 405. Inside this roller 406, a coil assembly 409 comprising a coil 402 and a core 401 and a holder 404 for retaining the coil assembly 409 are set in place. The roller 406 is formed of a heat-resistant insulating member, for example. In this compact construction, the belt 405 which contacts the roller 406 is enabled to generate heat in a wide range and the recording member 8 conveyed into the gap between the belt 405 and the roller 406 is heated in a wide range to effect the fixation as required.

EXAMPLE 12

Example 12 is still another embodiment which is applicable to Examples 1–5 described above.

Figure 32:
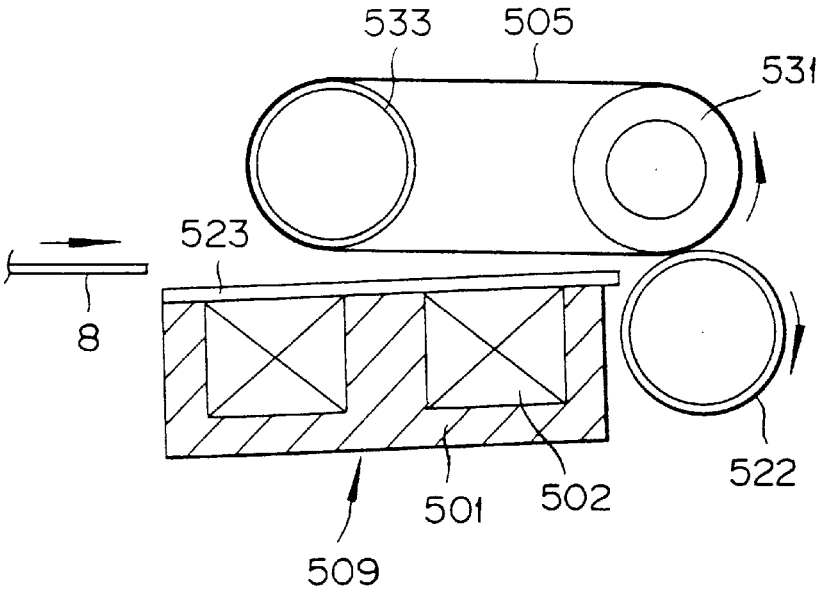
FIG. 32 is a cross section schematically illustrating the construction of a fixing unit as another mode of embodying this invention.

FIG. 32 is a cross section schematically illustrating the construction of a fixing unit according to Example 12.

The fixing unit illustrated in FIG. 32 omits the colliding belt 306 illustrated in FIG. 28. It has disposed on a coil assembly 509 a guide plate 523 for guiding the recording member 8 and has a pressure roller 522 disposed as pressed toward a drive roller 531 through the medium of a belt 505.

In this fixing unit, the belt 505 is caused to generate heat by the high-frequency current flowing through the coil 502 of the coil assembly 509 composed of the core 501 and the coil 502 and the toner image-carrying sheet 8 introduced from the direction of an arrow indicated in the diagram is heated without contact by the hot belt 505. In this part, the developing agent is softened to a certain degree and the developing agent and the recording member 8 are allowed to accumulate heat to a certain degree. Then, the sheet 8 is advanced into the gap between the belt 505 and the pressure roller 522 which is pressed against the belt 505 and the developing agent is fixed on the recording paper 8 by virtue of pressure and heat. Even by this fixing unit, the fixation of the developing agent can be attained by the heating effected in a wide range on the sheet 8.

EXAMPLE 13

Example 13 is a further modification which is applicable to Examples 1–5 described above.

Figure 33:
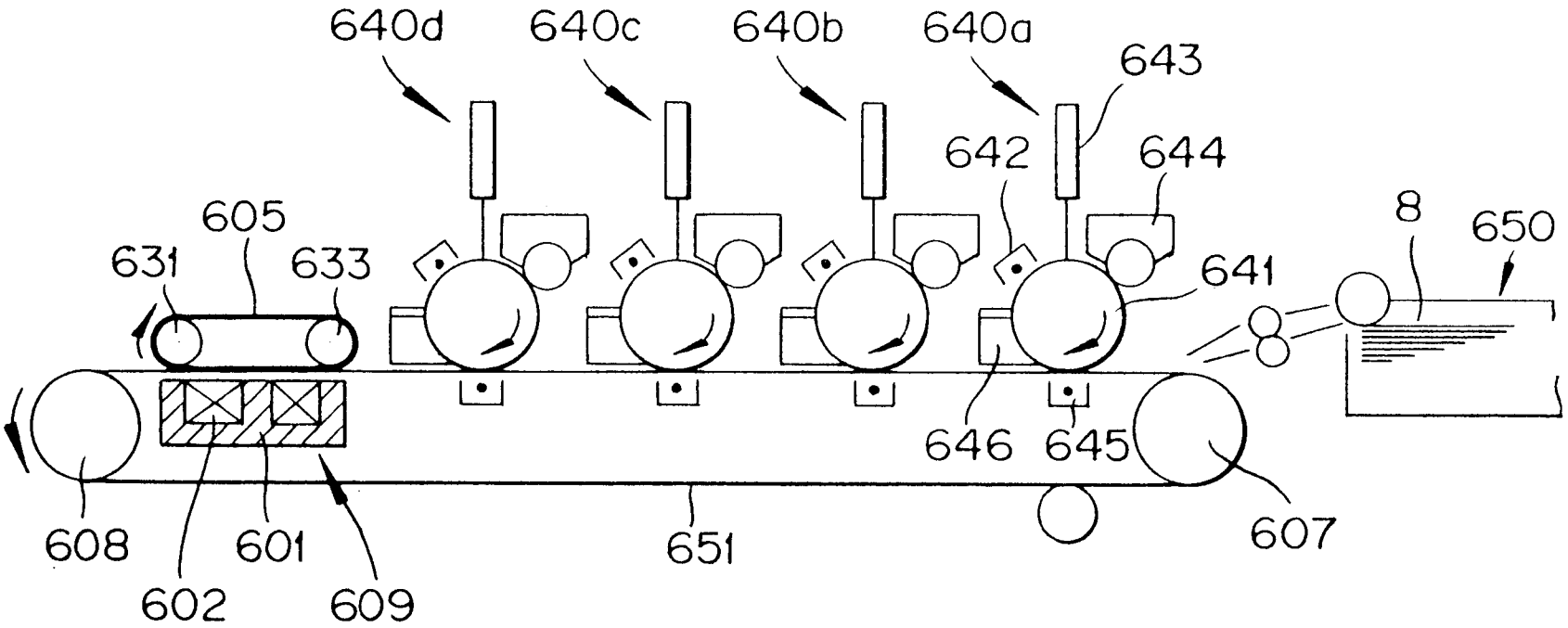
FIG. 33 is across section illustrating the essential part of an image forming apparatus using a fixing unit of Example 12 embodying this invention.

FIG. 33 is a cross section illustrating the essential part of an image forming device using a fixing unit according to Example 13.

The image forming device illustrated in FIG. 33 is a color image forming device provided with a recording member conveying belt 651 which is passed through a transfer part for transferring a plurality of developing agents of different colors onto the recording member. Along the longitudinal direction of the recording member conveying belt 661, image forming parts 640*a*–640*d* for forming images in four colors are disposed. These image forming parts are each provided with a photosensitive drum 641, a charger 642, a latent image forming part 643, a developing part 644, a transfer charger 645, and a cleaner 646. The developing part 644 for each of the image forming parts 640*a*–640*d* has the developing agents of cyan, magenta, yellow, and black colors contained therein in the order mentioned. It is enabled to form a color image by having images of the different colored sequentially transferred as superposed onto the sheet 8 supplied from a paper feeding part 650. The image forming device thus features a large throughput.

This mode of embodiment is characterized by the fact that the belt 605 including the conducting layer and for causing the developing agent on the sheet 8 to be fixed on the sheet 8 is disposed as opposed to the recording material conveying belt 651 and, at the same time, the coil assembly 609 comprising the coil 602 and the core 601 and serving as an induction heating source for effecting the necessary heating by inducing the belt 605 to produce an induced current is disposed near the belt 605.

Thus, the image forming device which utilizes the recording material conveying belt 651 as described above promises both miniaturization and economization of the system because it is allowed to omit the heretofore indispensable fixing unit as a separate component and enabled to effect the fixation of an image in a wide range of temperature on the recording member conveying belt 651 engaging in the operation of transfer. Since the color image forming device using several developing agents as shown in FIG. 33 generally occupies a large volume, the present embodiment can be advantageously used for this kind of image forming device.

The coil assembly 609 is preferred to be disposed inside the recording member conveying belt 651 as illustrated in FIG. 33. In this construction, the conveyance of the sheet 8 through the gap between the belt 605 and the recording member conveying belt 651 can be stabilized. The efficiency of heat conduction to the sheet 8 can be exalted because this sheet 8 is heated in the part in which it is held in intimate contact with the two belts. Thus, the miniaturization of the system is ensured all the more.

EXAMPLE 14

Example 14 is another modification which is applicable to Examples 1–5 described above.

Figure 34:
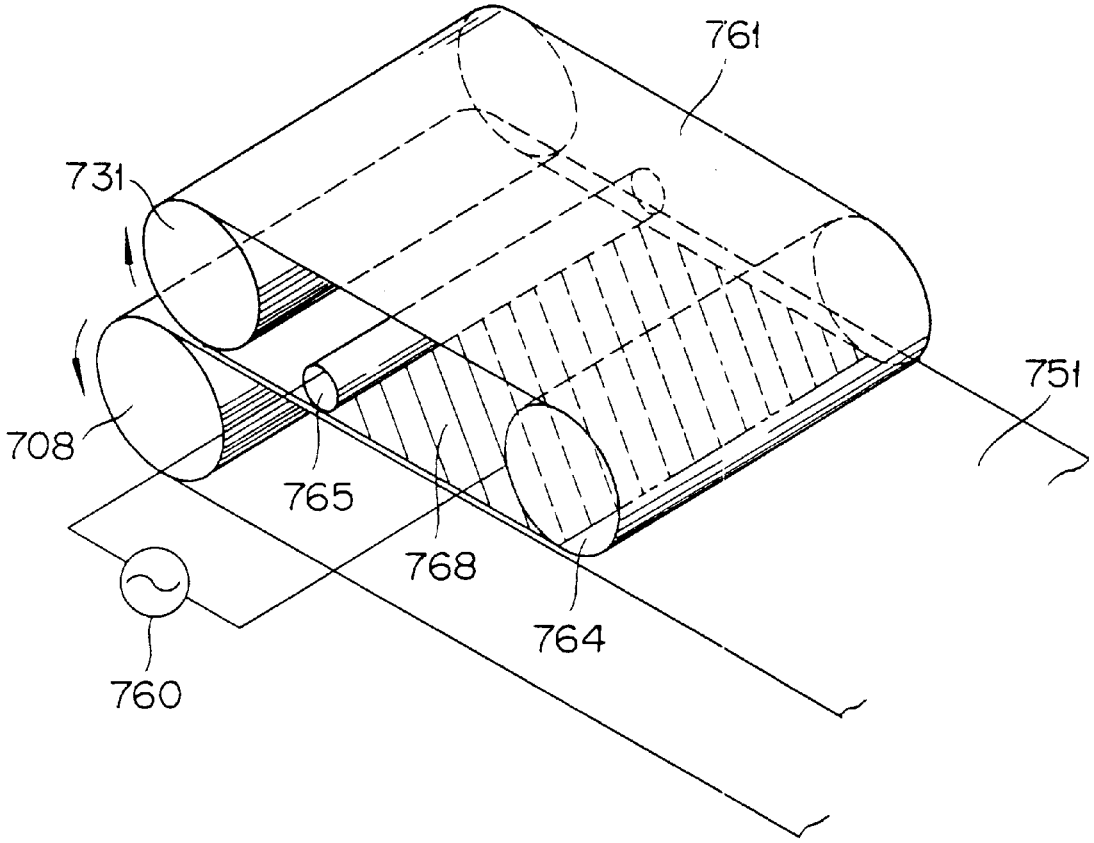
FIG. 34 is across section illustrating the essential part of the image forming apparatus shown in FIG. 33 using a fixing unit as another mode of embodying this invention.
Figure 35:
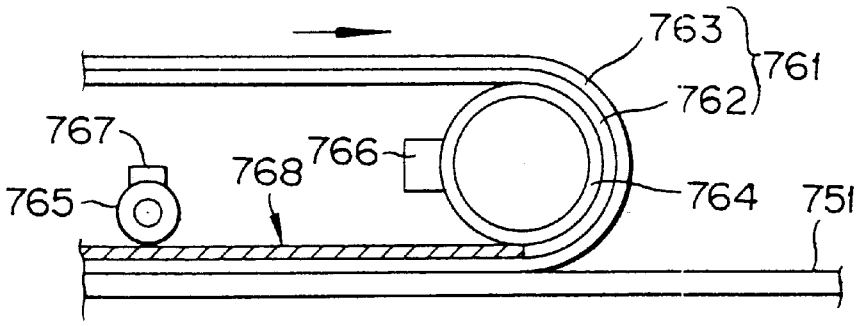
FIG. 35 is a magnified view of the neighborhood of a heating part shown in FIG. 34.

FIG. 34 is a cross section illustrating the essential part of the image forming device illustrated in FIG. 33 as utilized in a fixing unit of another embodiment and FIG. 35 is a magnified view of the vicinity of the heat generating part shown in FIG. 34.

The image forming device illustrated in FIG. 34 differs from the image forming device illustrated in FIG. 33 in respect that it uses a fixing belt 761 comprising a resistance layer 762 adapted to generate heat by passage of electricity therethrough and a heat-resistant release layer 763 formed on the peripheral face of the resistance layer 762 in the place of the conducting belt.

This fixing belt 761 is suspended in place together with a conducting roller 764 formed of a conducting material and a drive roller 731 and is disposed opposite the recording member conveying belt 751. An electrode roller 765 formed of a conducting material is disposed as pressed against the lower inner face of the fixing belt 761. The conducting roller 764 and the electrode roller 765 are connected to a power source 760 respectively through the medium of feeder brushes 766 and 767.

A heat generating part 768 can be made by electrification to generate heat in a wide range indicated by a hatch in the diagram. The range of heating can be adjusted by properly varying the position of the electrode roller 765. This embodiment realizes a further decrease in cost because it is not required to be provided with such an induction heating source as is used in the image forming device of FIG. 34. The entire disclosures of Japanese Patent Application No. 08-230996 filed on Aug. 30, 1996, Japanese Patent Application No. 08-229912 filed on Aug. 30, 1996, Japanese Patent Application No. 08-229934 filed on Aug. 30, 1996, and Japanese Patent Application No. 08-229910 filed on Aug. 30, 1996 each including specification, claims, drawings and summary are incorporated herein by reference in its entirely.

What is claimed is:

1. A heating device comprising:

a sleeve made of an electrical conductive material;

an electromagnet having a coil and a core;

an electrical power source, connected with said coil, for applying high-frequency electrical current to said coil to heat said sleeve by magnetic induction; and a detector which detects a condition of said sleeve based on an electrical power applied to said coil and a switching cycle of the application of said high-frequency electrical current to said coil.

2. The heating device as claimed in claim 1, wherein said detector detects temperature of said sleeve.

3. The heating device as claimed in claim 2, further comprising a controller which controls temperature of said sleeve based on the detection of said detector.

4. The heating device as claimed in claim 3, wherein said controller controls electrical current applied to said coil.

5. The heating device as claimed in claim 3, further comprising:

a thermistor for sensing a temperature of said sleeve, wherein said controller controls electrical current applied to said coil based on the detection of said detector and the temperature sensed by said thermistor.

6. The heating device as claimed in claim 2, wherein said detector has a first detector for detecting electrical current and a second detector for detecting electrical voltage.

7. The heating device as claimed in claim 1, wherein said detector detects the condition of said sleeve based on the electrical power applied to said coil and a frequency of the high-frequency electrical current.

8. The heating device as claimed in claim 1, wherein said electromagnet is provided in said sleeve.

9. The heating device as claimed in claim 1, wherein said electromagnet is provided outside of said sleeve.

10. A heating device comprising:

a sleeve made of an electrical conductive material;

an electromagnet having a coil and a core;

an electrical power source, connected with said coil, for applying high-frequency electrical current to said coil to heat said sleeve by magnetic induction; and a detector which detects a condition of said sleeve based on an electrical power applied to said coil.

11. The heating device as claimed in claim 10, further comprising:

a driver which rotates said sleeve; and a controller which controls said driver to stop the rotation of said sleeve based on the detection of said detector.

12. A method of detecting a condition of a sleeve made of an electrical conductive material, said sleeve being heated by an electromagnet having a coil and a core, said method comprising the steps of:

applying high-frequency current to said coil of said electromagnet;

detecting electrical power applied to said coil;

detecting a switching cycle of the application of said high-frequency electrical current to said coil; and determining said condition based on the detected electrical power and the detected switching cycle.

13. The method as claimed in claim 12, wherein said step of detecting electrical power comprises the steps of:

detecting electrical voltage applied to said coil; and detecting electrical current applied to said coil.

14. The method as claimed in claim 12, further comprising the step of: detecting frequency of the high-frequency electrical current.

15. The method as claimed in claim 12, further comprising the step of: detecting a temperature of said sleeve by a thermistor.

16. A method of controlling temperature of a sleeve made of an electrical conductive material, said sleeve being heated by an electromagnet having a coil and a core, said method comprising the steps of:

applying high-frequency current to said coil of said electromagnet;

detecting electrical power applied to said coil;

detecting a switching cycle of the application of said high-frequency electrical current to said coil; and controlling temperature of said sleeve based on the detected electrical power and the detected switching cycle.

17. The method as claimed in claim 16, further comprising the step of:

fourth step of detecting frequency of the high-frequency electrical current, wherein said control in third step is executed based on the detections of the second step and the fourth step.

* * * * *